US010799867B2

(12) United States Patent
Issadore et al.

(10) Patent No.: US 10,799,867 B2
(45) Date of Patent: Oct. 13, 2020

(54) APPARATUS FOR GENERATING MICRODROPLETS AND METHODS OF MANUFACTURING

(71) Applicant: The Trustees of the University of Pennsylvania, Philadelphia, PA (US)

(72) Inventors: David Aaron Issadore, Philadelphia, PA (US); Daeyeon Lee, Wynnewood, PA (US); Sagar Prasad Yadavali, Philadelphia, PA (US); Venkata Yelleswarapu, Philadelphia, PA (US); Heon-Ho Jeong, Philadelphia, PA (US)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 172 days.

(21) Appl. No.: 15/762,860

(22) PCT Filed: Sep. 23, 2016

(86) PCT No.: PCT/US2016/053273
§ 371 (c)(1),
(2) Date: Mar. 23, 2018

(87) PCT Pub. No.: WO2017/053678
PCT Pub. Date: Mar. 30, 2017

(65) Prior Publication Data

US 2018/0236450 A1 Aug. 23, 2018

Related U.S. Application Data

(60) Provisional application No. 62/232,139, filed on Sep. 24, 2015.

(51) Int. Cl.
*B01L 3/00* (2006.01)
*B01F 13/00* (2006.01)
(Continued)

(52) U.S. Cl.
CPC ..... *B01L 3/502776* (2013.01); *B01F 3/0807* (2013.01); *B01F 13/0062* (2013.01);
(Continued)

(58) Field of Classification Search
CPC ..... B01F 13/0062; B01F 13/1022; B01F 3/0807; B01L 2200/0636; B01L 3/502707;
(Continued)

(56) References Cited

U.S. PATENT DOCUMENTS 4,919,388 A * 4/1990 Koike ..... B29C 33/424 249/115
2004/0195728 A1* 10/2004 Slomski ..... B01L 3/502707 264/328.1
(Continued)

FOREIGN PATENT DOCUMENTS

WO 2015050960 A1 4/2015
WO WO-2015050960 A1 * 4/2015

OTHER PUBLICATIONS

International Preliminary Report on Patentability for Application No. PCT/US2016/053273, dated Mar. 27, 2018—7 pages.
(Continued)

*Primary Examiner* — Jennifer Wecker
(74) *Attorney, Agent, or Firm* — BakerHostetler

(57) ABSTRACT

Aspects of the present invention relate to apparatuses for microdroplet generation and methods of manufacturing such apparatuses. In accordance with one aspect, a method for manufacturing a microdroplet generator having a plurality of flow-focusing generators includes forming a cavity between a first plate and a second plate, the second plate being a soft master. The cavity defining the plurality of flow focusing generators, a first plurality of channels, and a second plurality of channels. The method further includes supplying a
(Continued)

resin to the cavity, applying pressure to one or both of the first plate or the second plate; and curing the resin.

13 Claims, 26 Drawing Sheets

(51) Int. Cl.
*B01F 13/10* (2006.01)
*B01F 3/08* (2006.01)

(52) U.S. Cl.
CPC .... *B01F 13/1022* (2013.01); *B01L 3/502707* (2013.01); *B01L 3/502715* (2013.01); *B01L 3/502784* (2013.01); *B01L 2200/0636* (2013.01)

(58) Field of Classification Search
CPC ..... B01L 3/502715; B01L 3/502776; B01L 3/502784
See application file for complete search history.

(56) References Cited

U.S. PATENT DOCUMENTS

2011/0053151 A1 3/2011 Hansen et al.
2012/0121481 A1* 5/2012 Romanowsky ..... B01F 3/0807 422/502
2014/0338753 A1* 11/2014 Sperling ..... B01F 13/0062 137/13
2016/0271609 A1* 9/2016 Issadore ..... B01F 13/0062

OTHER PUBLICATIONS

International Search Report and Written Opinion for International Application No. PCT/U52016/053273, dated Dec. 15, 2016—7 pages.

* cited by examiner 134a
134b
194
132a
132b
136
136
122
120
194
Through-hole
Delivery channel
FFG
Delivery channel
Supply channel
Oil
18 μm
700 μm
30 μm
High-height channel
Low-height channel FIG. 16A
$\mu_d / \mu_c = 0.0113$
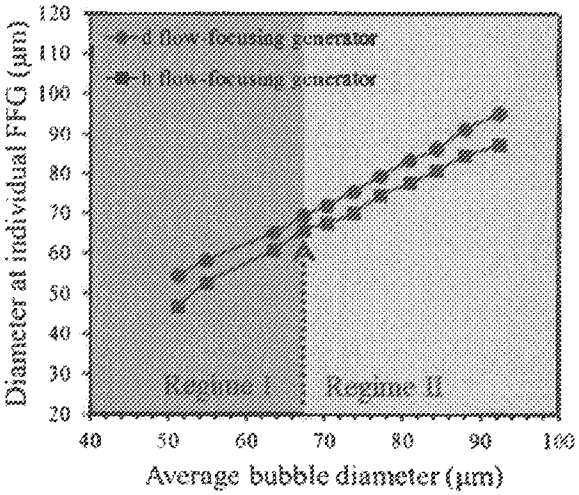
FIG. 16B
$\mu_d / \mu_c = 0.0051$
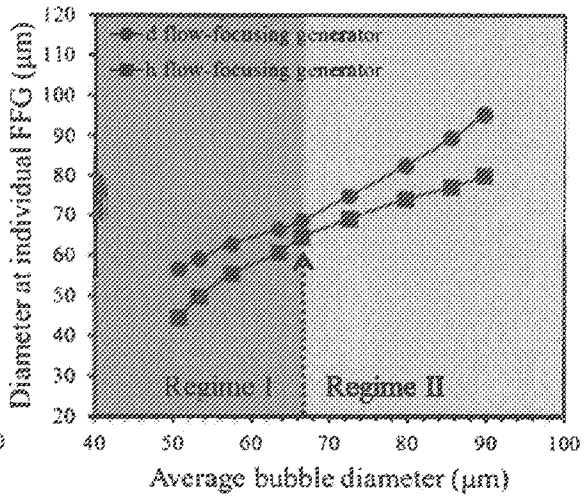
$\mu_d / \mu_c = 0.0017$
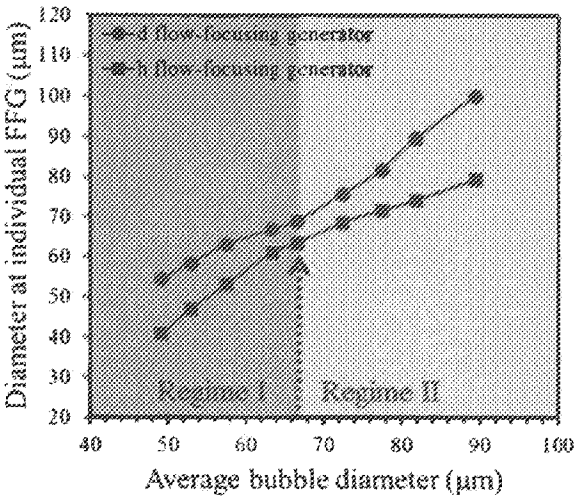
FIG. 16C
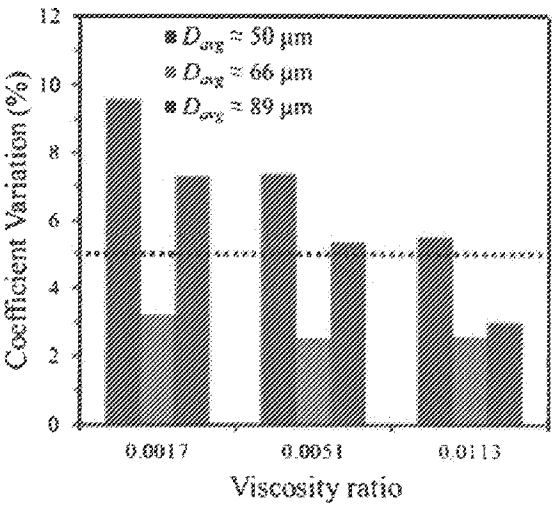
FIG. 16D

| Row | WIDTH (μm) | Height (μm) | $1/(HW^3)$ | $D_{avg}$ (μm) |
|---|---|---|---|---|
| 1 | 639.9 (7.7%) | 1193.7 (1.1%) | $3.31 \times 10^{-12}$ (22.1%) | 42.7 (3.3%) |
| 2 | 632.4 (6.7%) | 1195.5 (1.7%) | $3.39 \times 10^{-12}$ (19.4%) | 40.6 (2.2%) |
| 3 | 633.9 (6.3%) | 1195.8 (2.0%) | $3.36 \times 10^{-12}$ (17.9%) | 40.4 (3.3%) |
| 4 | 624.6 (6.0%) | 1217.2 (2.0%) | $3.44 \times 10^{-12}$ (17.5%) | 38.6 (3.0%) |
| 5 | 615.8 (5.9%) | 1233.7 (1.7%) | $3.46 \times 10^{-12}$ (17.0%) | 39.1 (3.2%) |
| 6 | 620.5 (5.6%) | 1277.8 (1.7%) | $3.47 \times 10^{-12}$ (16.4%) | 38.9 (4.2%) |
| 7 | 608.9 (5.7%) | 1290.2 (1.4%) | $3.50 \times 10^{-12}$ (15.9%) | 37.5 (3.1%) |
| 8 | 597.2 (6.1%) | 1313.6 (1.1%) | $3.54 \times 10^{-12}$ (17.9%) | 37.9 (3.7%) |
| Avg. | 622.3 (6.6%) | 1238.5 (3.8%) | $3.44 \times 10^{-12}$ (18.1%) | 39.5 (5.2%) |

APPARATUS FOR GENERATING MICRODROPLETS AND METHODS OF MANUFACTURING

CROSS REFERENCE TO RELATED APPLICATIONS

This application is a U.S. National Phase filing of International Application PCT/US2016/053273, filed Sep. 23, 2016, and claims priority to U.S. Provisional Application No. 62/232,139, entitled APPARATUS FOR GENERATING MICRODROPLETS AND METHODS OF MANUFACTURING, filed Sep. 24, 2015, the contents of which are incorporated by reference herein in their entirety.

FIELD OF THE INVENTION

This disclosure relates to microfluidic devices and methods of manufacturing the same.

BACKGROUND OF THE INVENTION

Microfluidics have been used to generate a wide variety of micro-scale emulsions and microbubbles, with control over size, shape, and composition not possible with conventional methods. These microfluidic devices utilize a flow geometry known as a droplet maker or drop maker.

The small scale of microfluidics allows precise control of the balance between surface tension and viscous forces in multiphasic flows, making it possible to generate highly monodisperse droplets. Micrometer-scale droplets and/or emulsions have been utilized for a wide variety of applications including digital biological assays, the generation of functional microparticles, and the on-chip synthesis of nanoparticles. However, by virtue of its small feature sizes, droplet microfluidic devices have been limited to low volumetric production, making traditional microfluidic droplet makers unsuitable for high production commercial applications.

Microbubbles are versatile templates to build functional materials in many fields including medicine, material science, and food industry. However, large-scale production of monodisperse microbubbles on microfluidics remains challenging for industrial application.

SUMMARY OF THE INVENTION

Aspects of the invention relate to apparatuses for microdroplet generation on a kilo-scale and methods of manufacturing such apparatuses.

In accordance with one aspect, the invention provides a method for manufacturing a microfluidic device comprising a plurality of flow-focusing generators. The method includes the steps of forming a cavity between a first plate and a second plate. The cavity defines at least one fluid inlet, at least one fluid outlet, and a plurality of flow focusing generators, a first plurality of channels, and a second plurality of channels. The method further includes supplying a resin to the cavity, applying pressure to one or both of the first plate or the second plate, and curing the resin.

According to another aspect, the invention provides a microdroplet generator including a monolithic substrate. The microdroplet generator further includes an inlet for receiving a continuous phase fluid, an inlet for receiving a dispersed phase fluid, and a plurality of channels. The plurality of channels is in fluid communication with both the inlet of the continuous phase fluid and the inlet of the dispersed phase fluid. Additionally, the microdroplet generator includes a plurality of flow focusing generators configured to produce microdroplets, each of the flow focusing generators in fluid communication with the plurality of channels, and one or more outlets for delivery of the microdroplets. A number of the plurality of flow-focusing generators is more than two greater than a number of the one or more outlets for delivery of the microdroplets.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures:

FIGS. 16A-16C are graphs showing microbubble diameter change at two microbubble droplet generators (largest and smallest microbubble generation at d- and h-FFG) among 8-FFGs, at viscosity ratios of 0.0113, 0.0051, and 0.0017, respectively, in accordance with aspects of the invention;

FIG. 16D is a graph comparing the viscosity ratios of FIGS. 16A-16C to the coefficient variation;

DETAILED DESCRIPTION OF THE INVENTION

Aspects of the invention are directed to apparatuses and methods of manufacture for microdroplet generators.

In conventional single-layer microfluidics, the number of inlets and outlets scales with the number of droplet generators, thus, creating a practical limit on the number of droplet generators that can be integrated onto a single device. The inventors have recognized that by incorporating a second layer of microfluidic channels to supply each flow focusing generator large arrays of droplet generators can be operated using only a single set of inlets and outlets. These multi-layer devices, however, are conventionally fabricated by way of micromill machining and deep reactive ion etching (DRIE) of hard materials (e.g., polymethylmethacrylate or glass), and soft-lithography/laser machining of soft elastomers such as polydimethylsiloxane (PDMS).

The inventors recognized that several disadvantages exist with such conventional methods. For example, the alignment and bonding of different pieces in these multi-component devices tend to reduce the reliability of device fabrication and lead to fluid leakage when the devices are operated at the high pressures necessary for high throughput droplet production. Moreover, misalignment between pieces can cause non-uniform distribution of fluid flows, resulting in polydisperse droplets.

The inventors have thus recognized that it would be useful to provide an apparatus, as well as a process for manufacturing such an apparatus, that can provide kilo-scale generation of, e.g., microdroplets and/or microbubbles.

As used herein, the phrases "continuous phase" and "disperse phase" are used generically to describe the fluid that the droplets and/or microbubbles are contained in and the fluid comprising the droplets and/or microbubbles, respectively.

As used herein, the term "fluid" is not limited to liquid substances, but may include substances in the gaseous phase, such as with, e.g., microbubbles.

Figure 1:
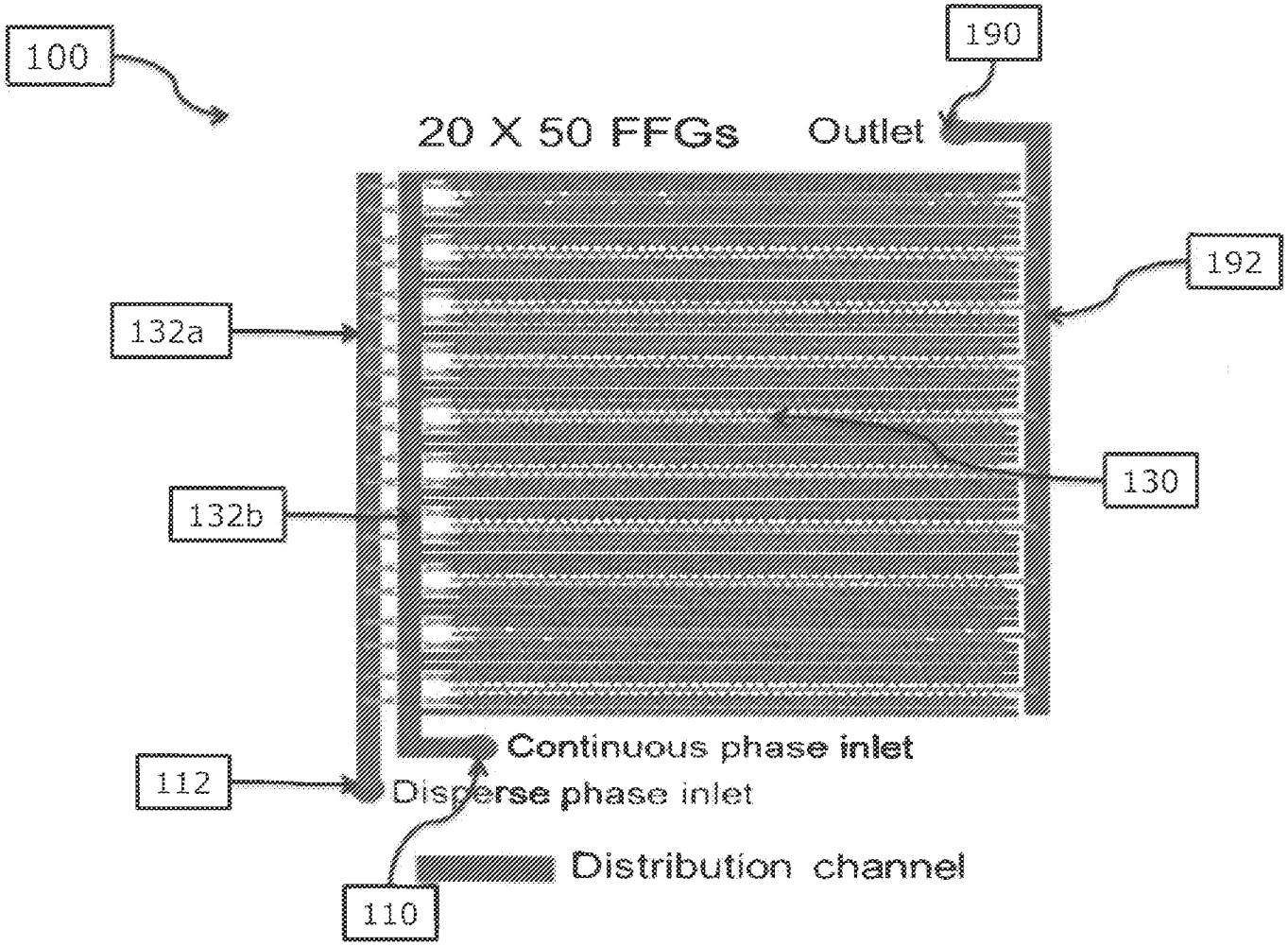
FIG. 1 is a schematic illustration of a microdroplet generator in accordance with aspects of the invention.

FIG. 1 is a schematic illustration of a microdroplet generator 100 for use in a microfluidic device for generating microdroplets on a kilo scale. As a general overview, microdroplet generator 100 includes a monolithic substrate having defined therein an inlet 110 for receiving a continuous phase fluid; an inlet 112 for receiving a dispersed phase fluid; a plurality of flow focusing generators 120; a plurality of channels 130; and one or more outlets 190 for delivery of the microdroplets (which in one embodiment refers to microbubbles).

Microdroplet generator 100 includes one or more inlets 110 and 112, for receiving the continuous phase and the dispersed phase, and one or more outlets 190 for delivering the produced microdroplets. In one embodiment microdroplet generator 100 has a single continuous phase inlet 110 and a single dispersed phase inlet 112. In another embodiment, the microdroplet generator 100 includes a single outlet 190. Microdroplet generator 100 may be formed from a monolithic substrate.

Microdroplet generator 100 includes a plurality of flow focusing generators (hereafter also referred to as a "FFG" or "FFGs") 120, e.g., to mass produce emulsion droplets, vesicles, microbubbles, or the like. The flow focusing generators 120 may comprise any known flow focusing generator geometry. For example, the flow focusing generators 120 may be chosen from T-junction droplet makers, flow focusing droplet makers, Janus particle droplet makers, multiple emulsion droplet makers, and combinations thereof. In at least one embodiment, flow focusing generators 120 may all be the same type of droplet makers, or may comprise at least two different types of flow focusing generators. In another embodiment, one or more of the fluid focusing generators 120 in a plurality of fluid focusing generators include an additional fluid inlet to create a multiple emulsion.

A number of the plurality of flow-focusing generators may be more than two greater than a number of the one or more outlets for delivery of the microdroplets. In at least one embodiment, the microdroplet generator 100 may comprise at least 500 flow focusing generators 120, such as, for example, at least 1000 focusing generators 120, at least 10,000 flow focusing generators 120, at least 100,000 flow focusing generators 120, at least 1,000,000 flow focusing generators 120 or more. In at least one embodiment, microdroplet generator 100 comprises 500 to 5,000,000 flow focusing generators 120, such as, for example, from 1,000 to 2,000,000 flow focusing generators 120, or from 10,000 to 1,000,000 flow focusing generators 120.

Figures 2A, 2B, 2C:
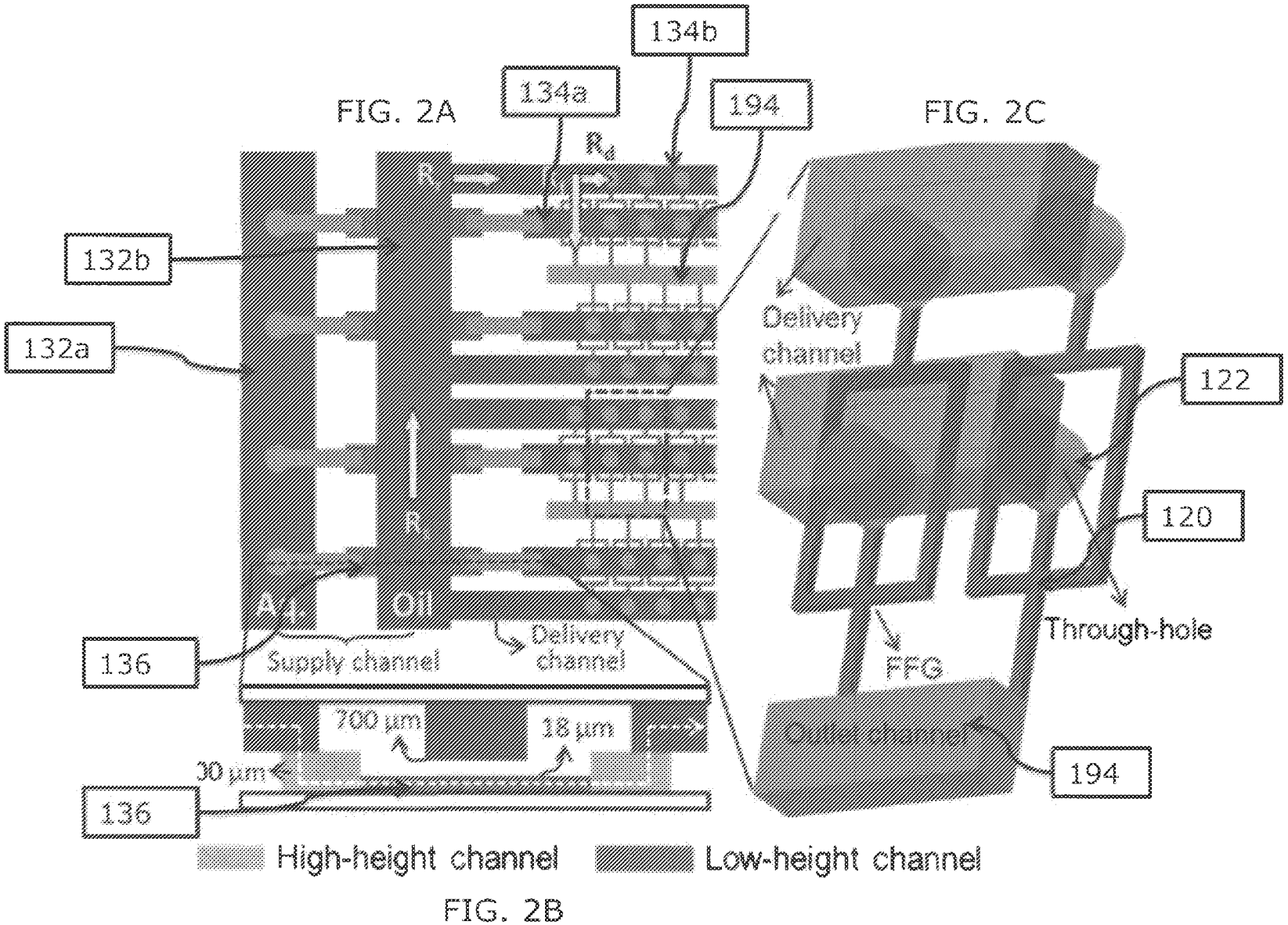
FIG. 2A is a schematic illustration of an enlarged portion of the microdroplet generator of FIG. 1.
FIG. 2B is a schematic illustration of a cross-sectional view of the portion of the microdroplet generator of FIG. 2A.
FIG. 2C is a schematic illustration of a perspective view of a portion of the microdroplet generator of FIG. 2A.

Although flow focusing generators 120 are illustrated in FIG. 2A-2C as being in parallel, flow focusing generators 120 may be in series. Preferably, microdroplet generator 100 includes flow focusing generators 120 that are in parallel, e.g., in a ladder configuration, which is further discussed below. In a ladder configuration, the flow focusing generators 120 are connected in parallel by way of the plurality of channels 130

Microdroplet generator 100 include a plurality of channels 130 configured to provide each flow focusing generator 120 with disperse phase fluid and continuous phase fluid, and to deliver the mixture, e.g., the emulsion or microdroplets, to outlet channel 192 and, ultimately, to outlet 190. For example, the plurality of channels 130 may be in fluid communication with the disperse phase inlet 112 and the continuous phase inlet 110. In one embodiment, the plurality of channels 130 may include supply channels 132, delivery channels 134, and outlet channel 192. One or more portions of the plurality of channels 130, 132, 134, 192 may comprise a set of one or more channels.

In one embodiment, the channels have a height at least 4 times greater than the height of the flow focusing generators 120. For example, the channels 130 may have a height ranging from 4 to 100 times greater than the height of the flow focusing generators 120, such as, for example, from 4 to 50 times greater, from 5 to 25 times greater, or from 10 to 20 times greater.

The channels 130 may have a height of at least 200 μm, such as, at least 250 μm, at least 300 μm, at least 400 μm, at least 500 μm, or greater. For example, the channels 130 may have a height ranging from about 200 μm to about 1000 μm, such as from about 250 μm to about 500 μm or from about 300 μm to about 400 μm. In accordance with at least one embodiment, the flow focusing generators 120 may have a height of 40 μm or less, 30 μm or less, 25 μm or less, 20 μm or less, or lower. In at least one embodiment, the flow focusing generators 120 have a height ranging from about 1 μm to about 40 μm, such as from about 5 μm to about 30 μm, or from about 10 μm to about 20 μm.

Figures 3A, 3B, 3C:
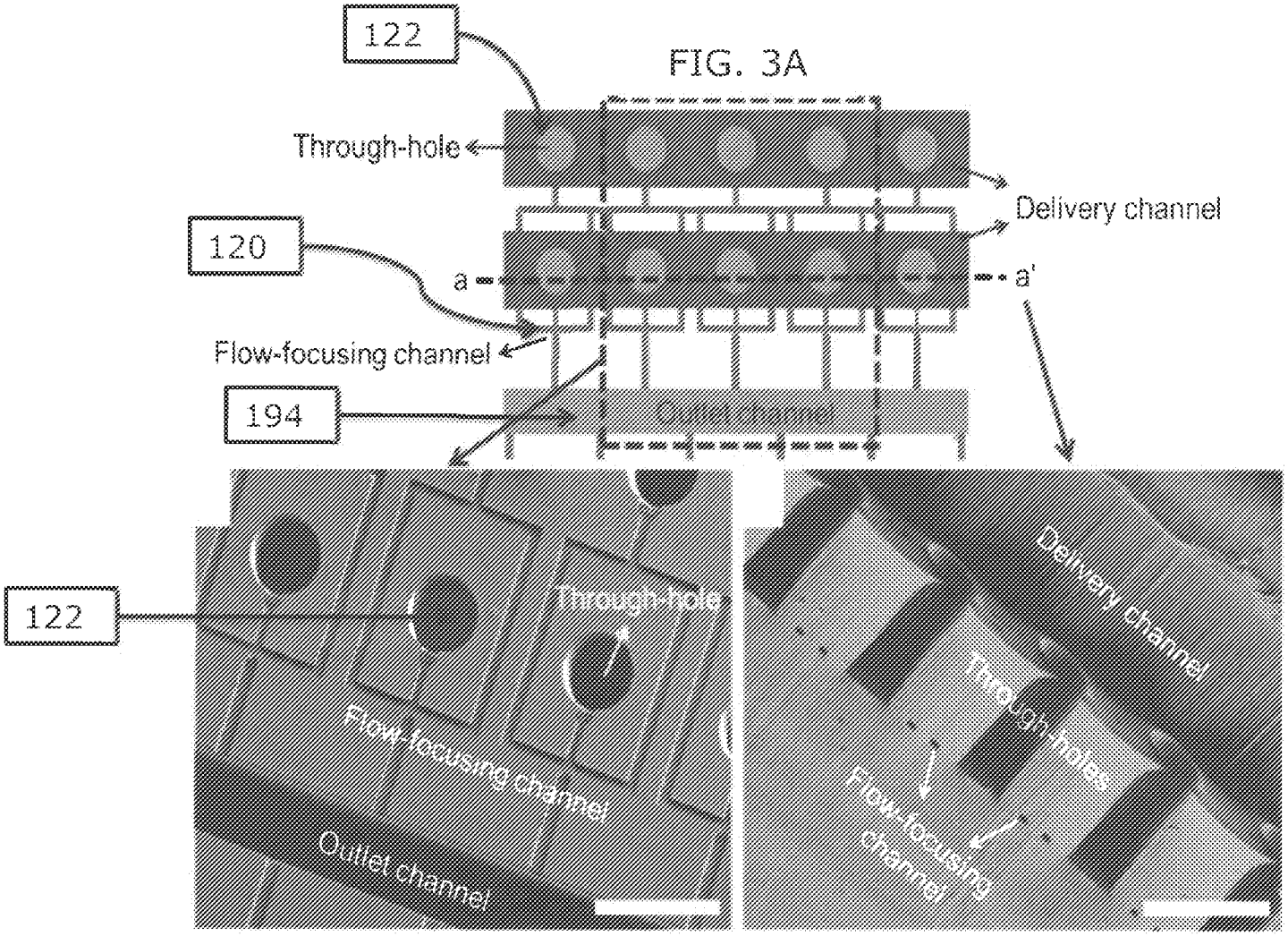
FIG. 3A is a schematic illustration of a flow focusing generator and a plurality of channels in fluid communication therewith according to aspects of the invention.
FIG. 3B is a perspective view of a portion of a microfluidic device corresponding to the schematic of FIG. 3A.
FIG. 3C is a cross-sectional view of a portion of a microfluidic device corresponding to the schematic of FIG. 3A.

Desirably, the plurality of channels 130 is configured such that the flow rates in each flow focusing generator 120 is uniform to ensure uniformity in the distribution of droplet size. In one embodiment, uniform droplet formation is obtained using a ladder geometry, where the spine of the ladder is formed by at least two supply channel 132*a* and 132*b* and the rungs of the ladder are formed by the delivery channels 134*a* and 134*b*. Although the delivery channels 134 are illustrated in FIG. 3A-3C as perpendicular to supply channels 132, delivery channels 134 may not perpendicular to supply channels 132, but may be angled with respect to supply channels 132. The delivery channels 134 are coupled to be in fluid communication with flow focusing generators 120 by way of vias (e.g., through-holes 122). Once droplets are generated, the droplets flow into the outlet channels rows 194 to outlet channel 192 to outlet 190.

To avoid a crossing between the delivery channels 134*a* for the dispersed phase and the continuous phase supply channel 132*b*, for example, an underpass 136 may be incorporated at the overlapping regions as shown in FIG. 1C. Although underpass 132 of dispersed supply channel 132*a* is depicted as passing under continuous supply channel 132*b*, in other embodiments, the underpass 132 of delivery channel 132*b* passes over or under supply channel 132*a*. In FIGS. 2A-2C, however, the dispersed phase travels from the supply channel 132*a* to the underpass 136 through an intermediate channel, having a height, in one embodiment, of 500 μm.

Preferably, the hydrodynamic resistance of the supply channels 132 is insignificant compared to that of the flow focusing generators 120. Additionally or alternatively, the pressure drop along the supply channel 132, remains small compared to the pressure drop across the individual flow focusing generators 120, such that $P_r<P_d$.

The microdroplet generator 100 may be designed such that Equation 1 is satisfied.

$$2N_f(R_d/R_f)<0.01 \quad \text{(Equation 1)}$$

where Rd is the fluidic resistance along the delivery channel 134 between each flow focusing generator 120, Rf is the fluidic resistance of individual flow focusing generators 120, and Nf is the number of flow focusing generators 120 in one row (FIG. 2A). The flow resistance of each rectangular channel can be estimated using R=12 μl/wh3, where μ is the dynamic viscosity of the fluid and w, h, and l are the width, height, and length of the channel.

To evenly distribute flow to each of the delivery channels 134, the resistance (Rs) of the supply channel 132 and the total resistance of each delivery channel 134 (Rd) is considered. To ensure that fluid flow is evenly distributed to each delivery channel 134, preferably the resistance associated with the delivery channels 134 and/or outlet channel rows 194 is much greater than that of the supply channel 132 connecting them. The resistance of each delivery channel 134 with Nf FFGs 120 can be approximated with Rrow~Rf/Nf since the resistance of the flow focusing generators 120 is much greater than that of the delivery channel 134, and as such each delivery channel's 134 resistance can be approximated as Nf flow focusing generators 120 in parallel. In one embodiment, the supply channel 132 dimensions are ws=1.4 mm, height hs=0.7 mm, and length ls=45 mm, e.g., for both the continuous delivery channels 134 (e.g., for the oil) and the delivery channel 132*a* (e.g., for the water) as well as for the outlet channel rows 194. For the delivery channels 134*a* and 134*b*, where each row consists of Nf=50 flow focusing generators 120, a number of delivery channels 134 of about or less than 64 is achieved. For the outlet channels 192, where Nf=100, a number of delivery channel 134 may be about or less than 13. In one embodiment, the number of delivery channel 134 is 20 and the number of outlet channel rows 192 is 10, which satisfies the design consideration to ensure even distribution of fluid to the rows.

In one embodiment, using a ladder geometry, microdroplet generator 100 employs over 1,000 flow focusing generators 120 on a 6×5 $cm^2$ device with only one set of inlets 112 and 110 and one outlet 190 to produce greater than 1,000 mL/hr. In another embodiment, microdroplet generator 100 has highest volumetric production rate per unit area of device to date (50 mL/(hr·cm2)).

Figure 5:
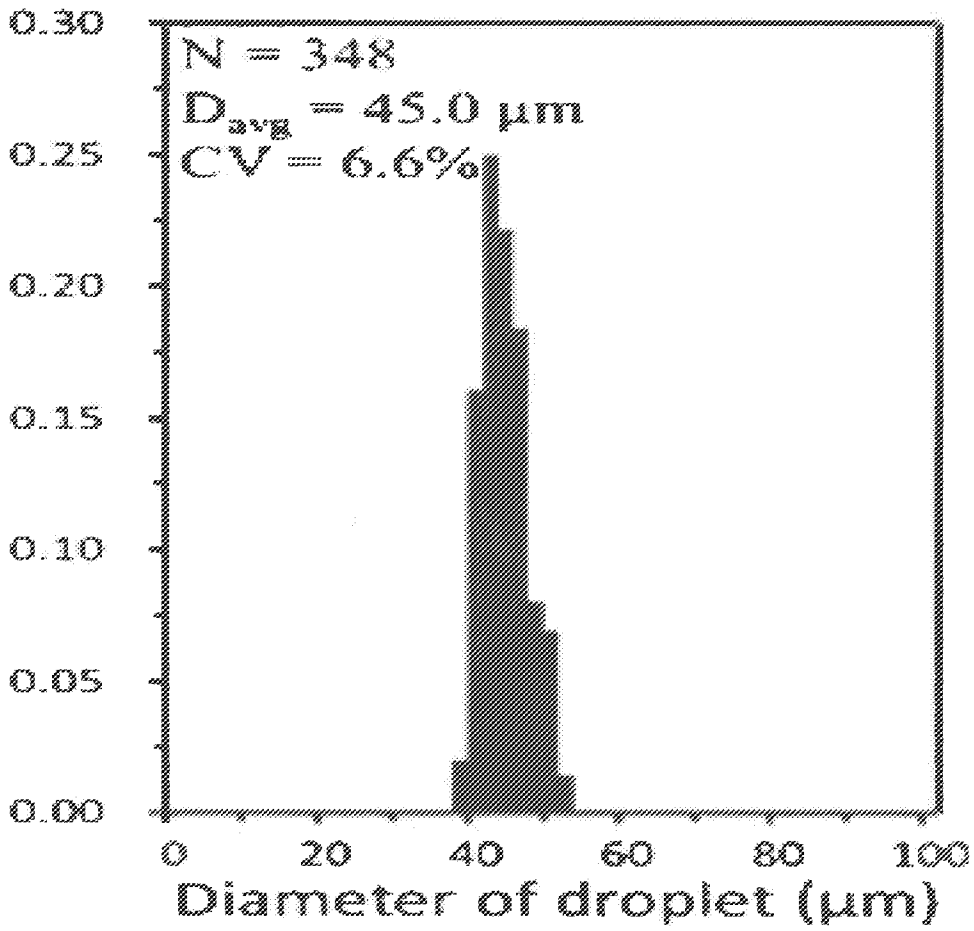
FIG. 5 is a graph depicting a size distribution for generated droplets according to aspects of the invention.
Figure 8:
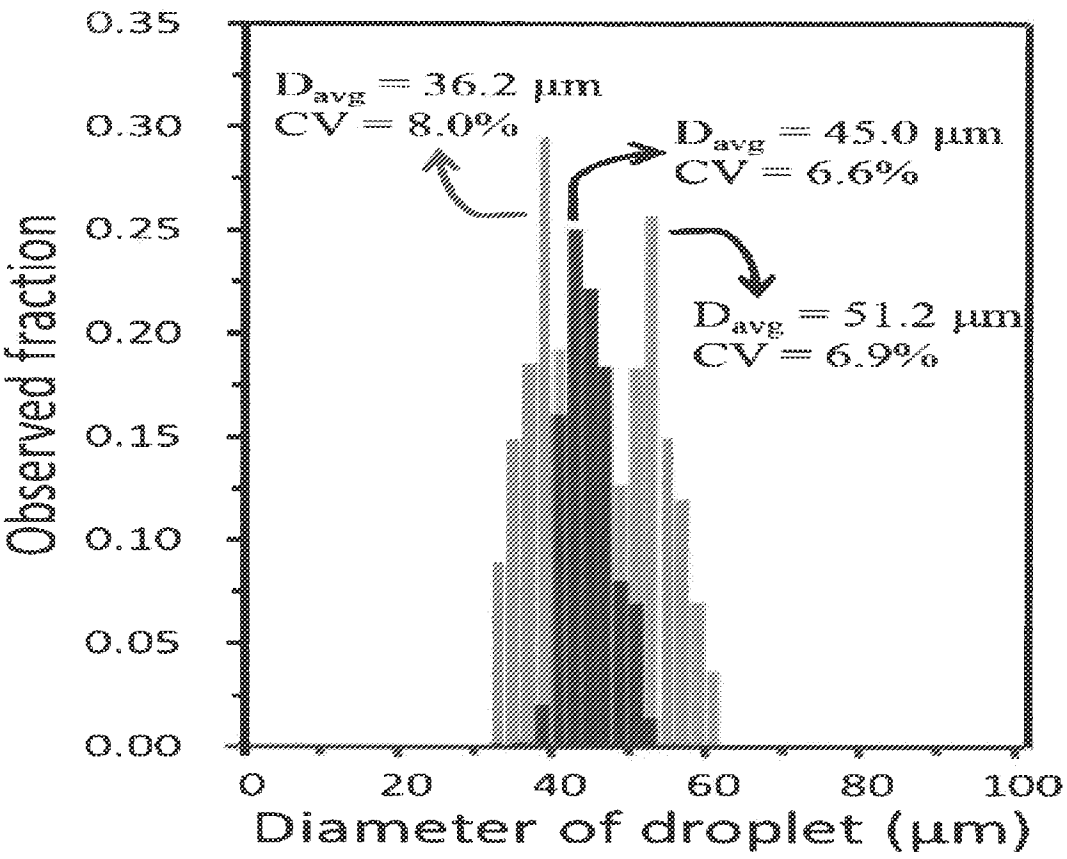
FIG. 8 is a graph depicting several size distributions for generated droplets according different parameters in accordance with aspects of the invention.

Microdroplet generator 100 may be configured such that the dispersed phase fluid and the continuous phase fluid are flow through microdroplet generator 100 under pressure. For example, pressures of 60 psi and 120 psi could be applied to feed the dispersed and continuous phases, respectively, thereby maintaining uniform and high flow rates. As seen in FIGS. 5 and 8, in one embodiment, to generate a uniform and small water-in-oil (W/O) emulsion droplets, microdroplet generator 100 is filled with oil (e.g., 2 wt % Span80 in hexadecane) until trapped bubbles are completely removed with the aqueous phase, preferably, subsequently introduced to form a W/O emulsion.

Figure 6:
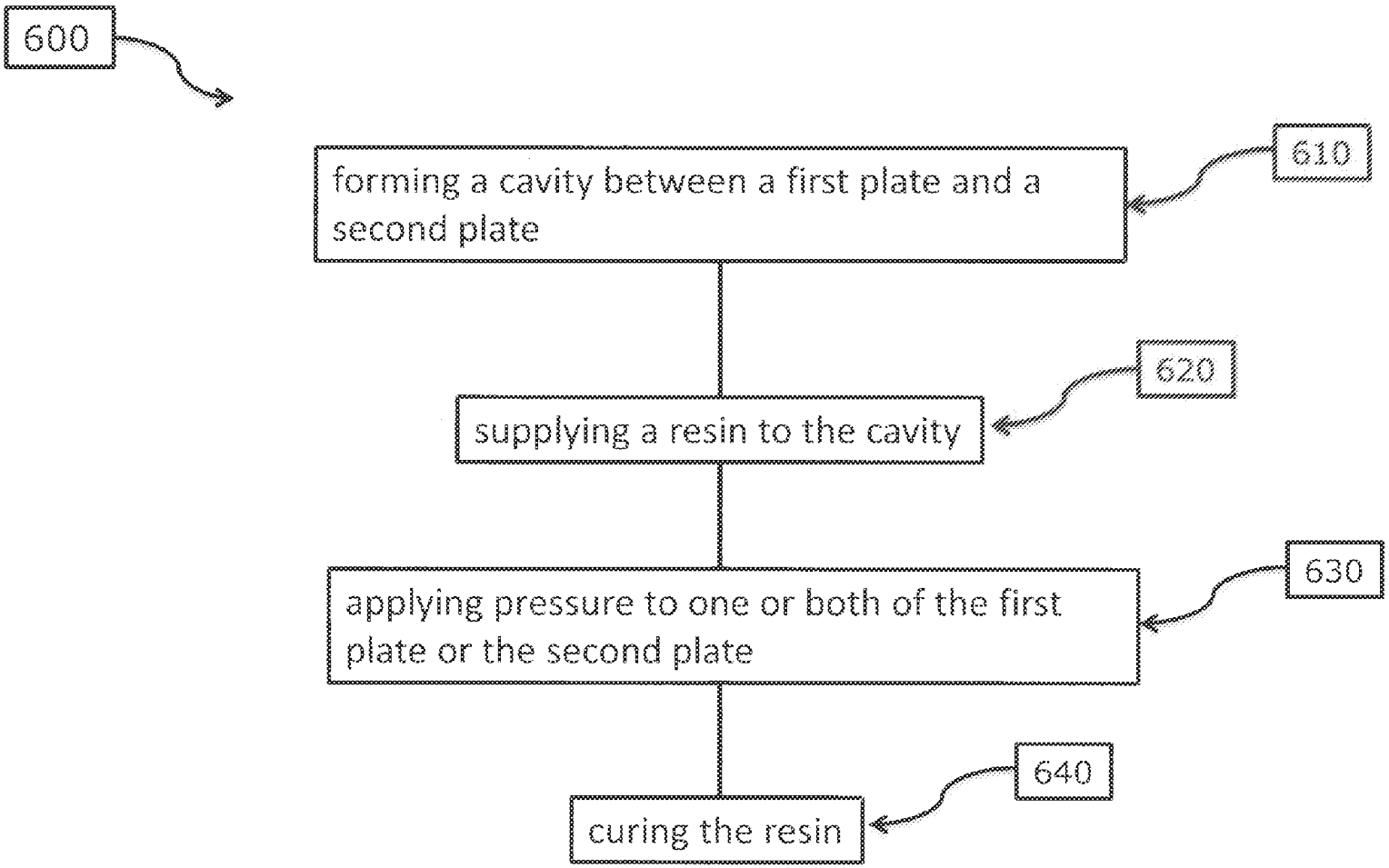
FIG. 6 is a method for manufacturing microdroplet generators in accordance with aspects of the invention.
Figure 7:
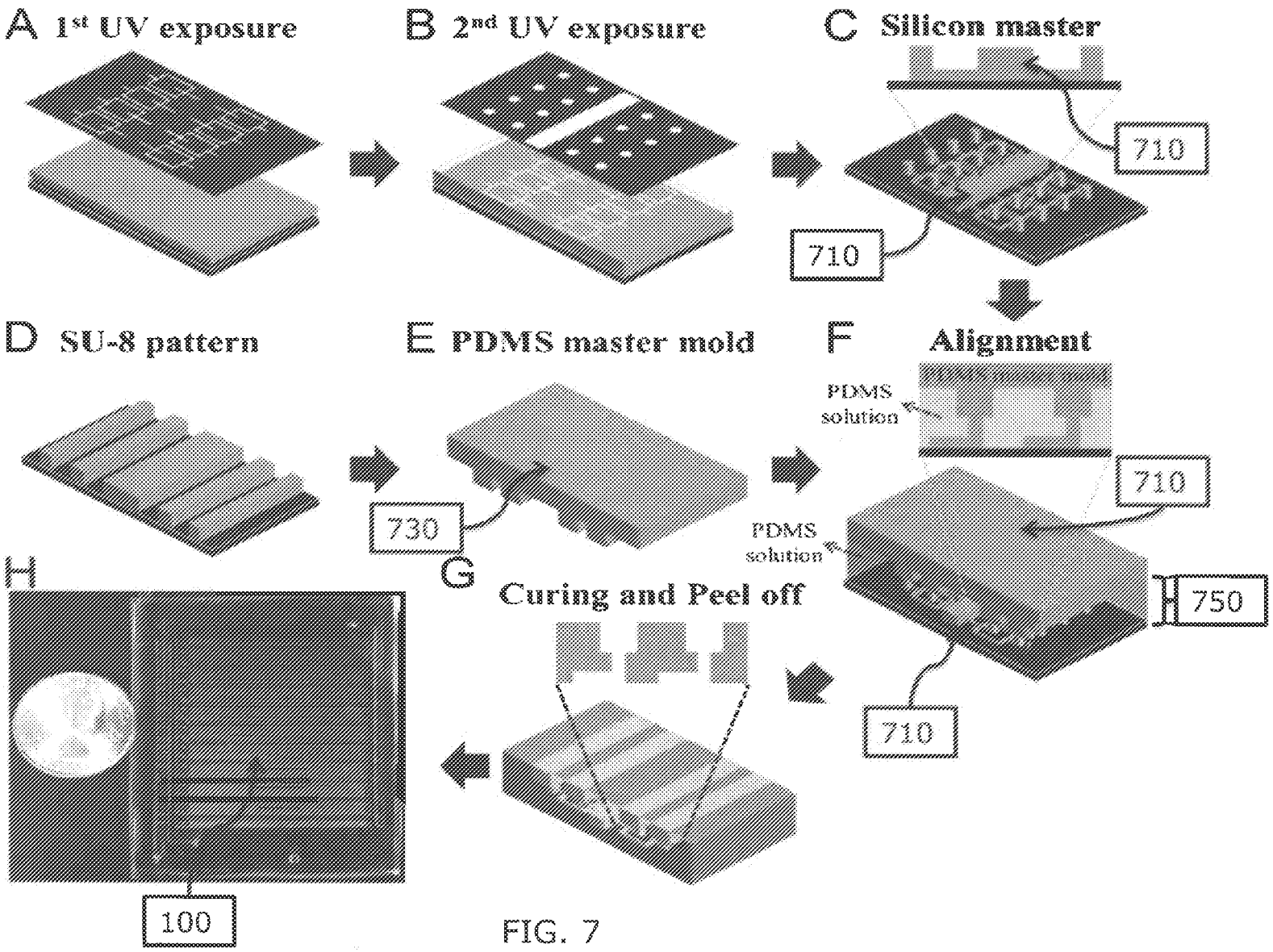
FIG. 7 is a schematic depicting a non-limiting example of the method for manufacturing microdroplet of FIG. 6.

FIGS. 6-7 depict a method 600 for manufacturing microdroplet generators in accordance with aspects of the invention. Method 600 may be employed to produce microfluidic devices, e.g., microdroplet generator 100, by molding a resin between the hard master plate 710 and the soft master plate 730, thereby enabling a three dimensional structure (e.g., microdroplet generator 100) to be rapidly and inexpensively cast.

As a general overview, method 600 includes forming a cavity between a hard master plate 710 and a soft master plate 730; supplying a resin to the cavity 750; applying pressure to one or both of the hard master plate 710 or the soft master plate 730; and curing the resin.

In step 610, the cavity 750 is formed between a hard master plate 710 and a soft master plate 730, the cavity 750 defining the plurality of flow focusing generators, a first plurality of channels, and a second plurality of channels. In one embodiment, the cavity defines at least one fluid inlet, at least one fluid outlet, the plurality of flow focusing generators, a first plurality of channels, and a second plurality of channels. The hard master plate 710 and the soft master plate 730 may be configured to be multi-height and, preferably, reusable. Any suitable methods may be used to produce the hard master plate 710 and/or the soft master plate 730 provided that the cavity 750 formed therebetween is capable of receiving a resin and forming a monolithic, three dimensional structure (e.g., microdroplet generator 100).

In one embodiment, to fabricate the multi-height hard master plate 710 a resin, e.g., a 18 μm thick negative tone photoresist SU-8, is first spin-coated onto a Si wafer. A photomask that includes the patterns for the flow focusing generators 120 and the underpass 136 phase may be used to UV expose portions of the hard master plate 710 on the Si wafer, as shown in FIG. 6. A resin of 500 μm thickness may be spin-coated onto the first layer. Another photomask that consists of the through-holes 122 and outlet channels 192 may be aligned to the first layer using a mask aligner (e.g., ABM3000HR), and UV exposure may subsequently performed. The patters of the multi-height hard master plate 710 are formed by removing the regions not exposed to the UV.

In one embodiment, conventional single-layer photolithography is used to make the soft master plate 730. A resin, e.g., SU-8 photoresist of thickness 700 μm, may be spin-coated and UV exposed through a photomask and then developed to obtain patterns for a mold for the soft mater plate, as shown in FIG. 6. The patterns for the mold may be silanized with tridecafluoro-1,1,2,2-tetrahydrooctyl-1-trichlorosilane. The soft mater plate mold may produce the soft mater plate 730 from a resin, e.g., PDMS mixed with cross-linker in the ratio 10:0.5, by way of pouring the resin on the soft master plate mold and curing at 65° C. for six hours and then peeling off the soft master plate mold to obtain the soft master plate 730. The soft master plate 730 may be subsequently silanized.

In step 620, a resin is supplied to the cavity 750. The resin may me poured onto one or both of the hard master plate 710 or the soft master plate 730 prior to forming cavity 750. Alternatively, the resin may be supplied to the already formed cavity 750. In one embodiment, uncured PDMS mixed with the cross-linker in the ratio 10:1 is poured onto both the soft master plate 730 and the hard master plate 710.

The soft master plate 730 and hard master plate 710 are aligned—preferably, with the aid of support patterns (e.g., 5 mm×5 mm) on both masters plate 710 and 730. After alignment, the resin in cavity 750 may be cured, e.g., on a hotplate at 65° for four hours by applying a pressure greater than 20 kPa on the soft master plate 730. Preferably, alignment is maintained between the two masters plates 710 and 730 and pressure is applied uniformly. In one embodiment, alignment is maintained and pressure uniformly applied by way of applying uniform pressure to a hard acrylic plate that is placed on top of the soft master plate 730 and/or by way of two binder clips (one attached on each side of the two masters 710 and 730). Desirably, all through-holes 122 remain open after curing of the resin within the cavity 750. The final 3D microfluidic device, e.g., microdroplet generator 100, may subsequently be obtained by peeling off the soft master plate 710 and then completely peeling the remaining resin from the hard master plate 730, as shown in FIG. 6. In one embodiment, to facilitate the separation of the microfluidic device, e.g., microdroplet generator 100, from the two masters 710 and 730, the two master plates 710 and 730 are silanized, e.g., with tridecafluoro-1,1,2,2-tetrahydrooctyl-1-trichlorosilane, after a plasma treatment.

The top and bottom of the microdroplet generator 100 may be plasma-bonded to thin (2 mm) and thick (1.5 cm) slabs of resin, e.g., PDMS, respectively. Injection holes (0.75 mm in diameter) for the fluids may be punched through the top PDMS slab using a stainless steel punch, and a syringe needle (outer diameter=0.92 mm) connected to polyethylene tubing (inner diameter=0.86 mm and outer diameter=1.32 mm) is inserted to each hole. In one embodiment, the microfluidic device, e.g., microdroplet generator 100, is subsequently affixed to a glass slide by way of plasma treatment for implementation in commercial uses.

The microfluidic device may be configured to provide microbubbles having a well-defined microbubble size and distribution. Well controlled microbubble size and distribution provides an attractive template and/or delivery system for numerous fields including medicine, material science, and the food industry. Specifically, homogeneous microbubble production to produce monodisperse microbubbles may provide numerous benefits for industries that use two-phase delivery systems having highly uniform properties and functions, such as ultrasound imaging, drug carrier, photonic crystal, and light-weight materials.

The inventors recognized that a key challenge to uniform microbubble production is that parallel gas microbubble generation is sensitive to the channel resistance variation. However, the inventors discovered that uniform microbubbles can be achieved by controlling the physical balance between surface tension and shear force associated with the microfluidic device, which can be represented by dimensionless Capillary number (Ca) (ratio of viscous force and surface tension force) and/or Weber number (ratio of inertial force and surface tension force).

The inventors further realized that one of the relevant parameters for scaled-up production of monodisperse microbubble/droplet is uniform fluid distribution to each parallel generator from single-set injector, which often employs complex microfluidic channel networks. As described above, the microfluidic device may have a ladder geometry that has straight channels, which are connected to many generators, thus making it possible to design a much higher density of 2D generators array. Fluid distribution using ladder-form channel network provides several advantages including compact FFG array and less sensitivity to channel dimension variation when channel resistance ratio between distribution and FFGs channels is high. For example, using a ladder configuration, uniform distribution of fluids can be achieved by considering microchannel resistance ratio between distribution and generator channels, which is not changed by channel clogging. In one embodiment, the channel resistance variation should be higher than microchannel dimension variation. The microfluidic networks described herein can provide scaled-up uniform emulsion droplets of over 100 ml/hour production rate. In addition, kilo-scale production of liquid droplets (1,000-FFGs and 1.5 L/hour rate) may be achieved in an elastomer microfluidic device (discussed herein) by using a ladder form microfluidic network.

Alternatively or additionally, the microfluidic device may have a tree-like branched geometry that can evenly divide fluids in symmetrically branched channels and can increase the number of droplet generators starting from one inlet port for each phase. In one alternative embodiment, up to 512 flow focusing generators are integrated to the fractal tree-like distribution network by three-dimensional stacking of Polymethyl methacrylate (hereafter "PMMA") layers, which could produce 100 μm liquid emulsion as high as 1 L/hour rate.

The microfluidic devices discussed above, which employ a ladder configuration, are conducive for large scale production of microbubbles. Using the methods of manufacturing disclosed herein, a high success rate of device fabrication may be achieved, e.g., by eliminating the need to simultaneously align and bind the multiple layers. In the above microfluidic devices, uniform fluid distribution using ladder-form channel, may be determined by employing the following equations:

$$R=12\ \mu l/wh^3 \text{ and} \tag{1}$$

$$2N_f(R_d/R_f)<0.01. \tag{2}$$

Figure 9B:
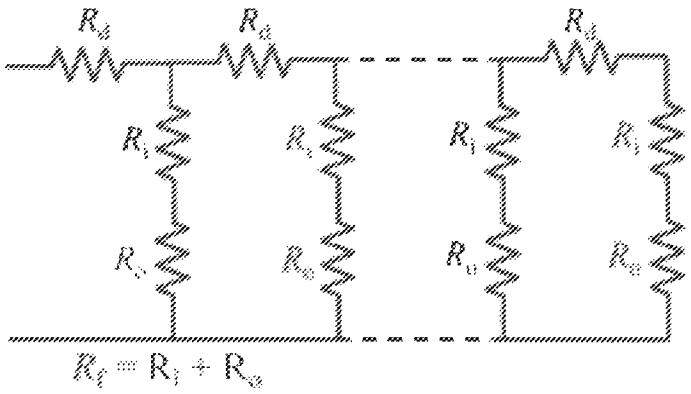
FIG. 9B is a schematic resistance model for uniform distribution of fluids that depends on channel resistance ratio between Rd and Rf in accordance with aspects of the present invention.
Figure 9A:
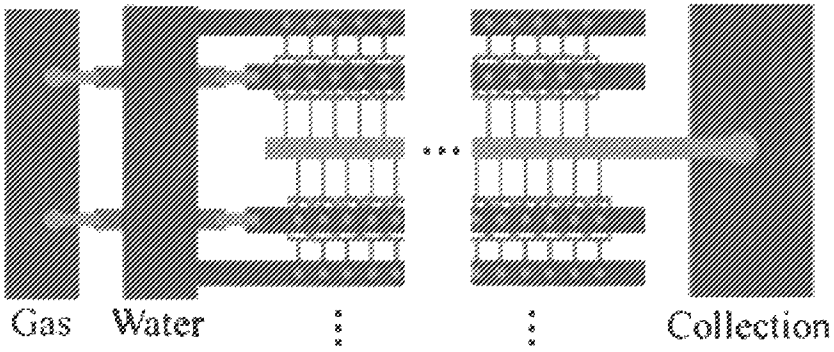
FIG. 9A is a schematic depicting FFGs using ladder-form distribution channel in 3D MED according to aspects of the present invention.
Figure 9C:
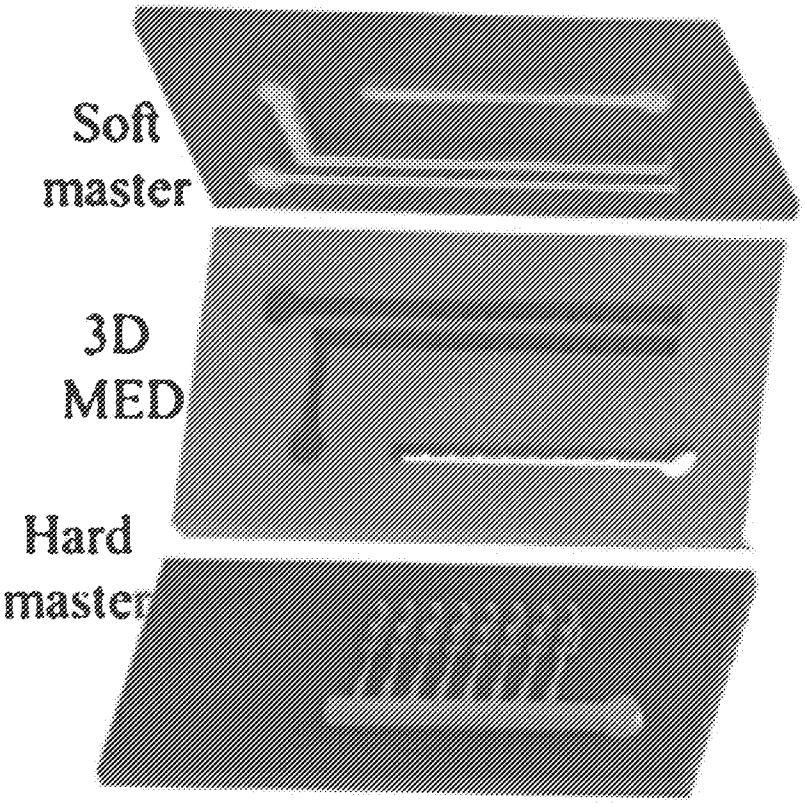
FIG. 9C illustrates a double sided imprinting for fabrication of a 3D MED using soft and hard master molds according to aspects of the present invention.

Equation (2) includes an assumption that the pressure drop is induced by single-phase fluid flows in identical microchannels. However, because the hydrodynamic resistance in the outlet channels for microbubble production uses two-phase flow after microbubble generation, the hydrodynamic resistance for FFG can be divided into single-phase fluid injection (hereafter "$R_i$") and two-phase flow (hereafter "$R_o$") in outlet channel (FIG. 9B). After the microbubble generation, the fluid condition in an outlet channel is altered into two-phase flow, which has higher hydrodynamic resistance than that of single-phase flow resistance. Particularly, the $R_o$ is dynamically changed as a two-phase flow condition, which corresponds to friction associated with channel surface, volume fraction, and thin lubrication films and corner gutter flow between moving phase and rectangular channel. The two-phase flow resistance act reversibly to channel resistance after microbubble generation, resulting to minimizing the microbubble size distribution as increasing the microbubble size/number in specific regime.

Regarding microbubble generation the microdroplet generators may have a narrow orifice to break-up the gas phase by focusing the shear force. Additionally, the microdroplet generators may have a consistent orifice size for producing uniformly sized microbubbles (e.g., monodisperse microbubbles). In one embodiment the microdroplet generators have a narrow and consistently sized orifice.

Figures 9D, 9E:
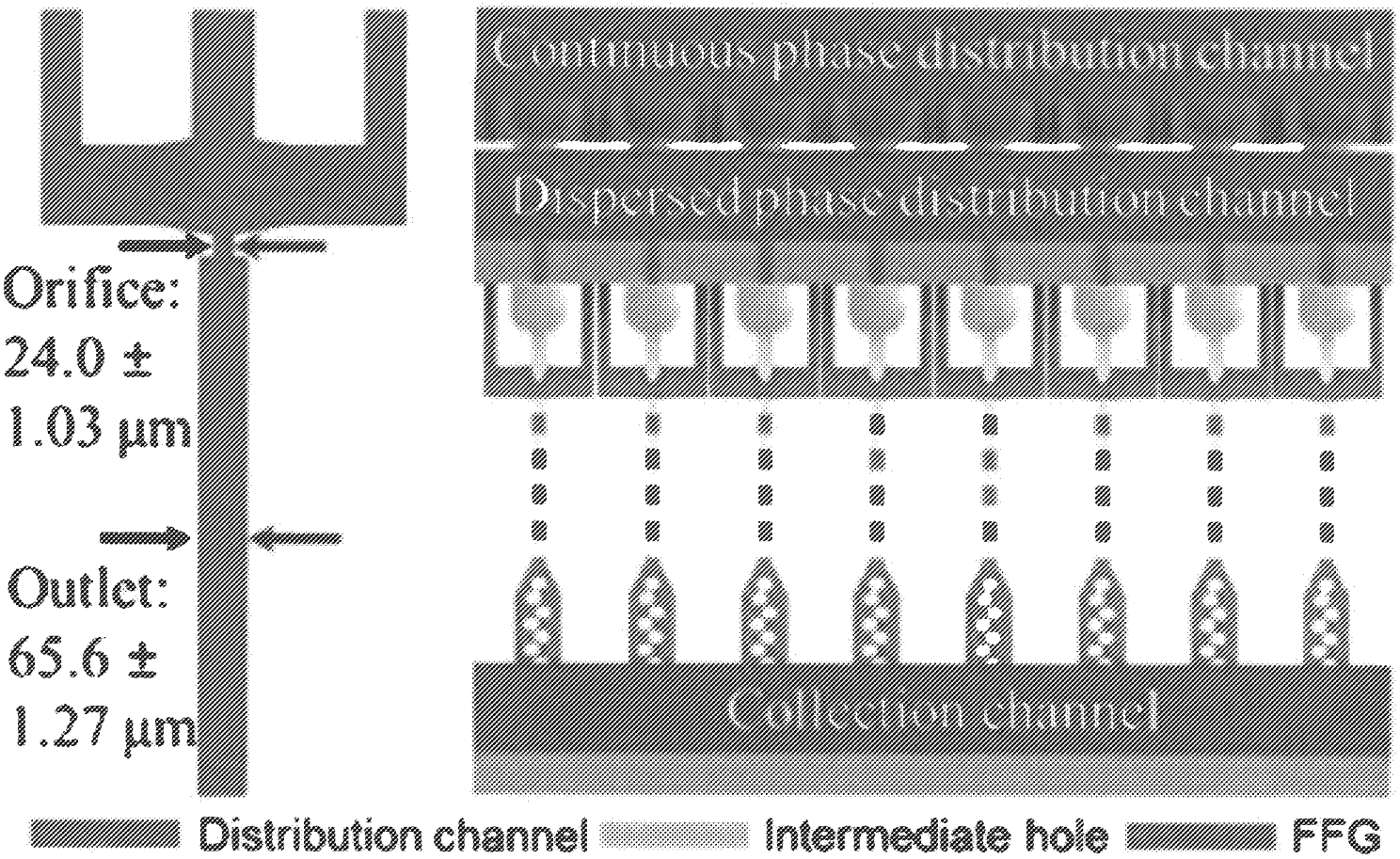
FIG. 9D is a schematic depicting a geometry of a FFG and the dimension variation in the orifice and outlet channels in accordance with aspects of the invention.
FIG. 9E is a schematic of 8 FFGs using a parallel ladder configuration according to aspects of the invention.

The inventors also recognized that random variation in the orifice channels (e.g., 24.0±1.03 μm width and 79 μm±1.39 μm height) and outlet channels (e.g., 65.6±1.27 μm width and 79 μm±1.39 μm height) can induce a large coefficient variation (CV) of orifice channel resistance (e.g., 12.4% CV) and outlet channel resistance (e.g., 6.5% CV), e.g., as seen in FIG. 9D. Accordingly, further improvements to the microfluidic device may be obtained by configuring the device such that the coefficient variation is reduced. For example, the microfluidic device may be configured to optimize parameters affecting the size distribution under variations including microchannel resistance and two-phase flow resistance.

The microfluidic device may be configured to satisfy the following criterion: $2N(R_d/R_f)<0.001$ for the microchannel resistance variation. By configuring the microfluidic device to satisfy $2N(R_d/R_f)<0.001$, non-uniform flow rates originating from variations in the microchannel dimensions may be reduced. In one embodiment, the microfluidic device has a CV of 12.4% or less for orifice channel resistance and a CV of 6.5% or less for outlet channel resistance.

The ratio of the flow rate for the dispersed phase (e.g., the gas phase) and the continuous phase (e.g., liquid phase) may be configured to produce more homogenous microbubble size and distribution. For example, monodisperse microbubbles (<5% CV) may be generated at uniform generation frequencies (e.g., <5% CV) in specific ranges of gas pressure (e.g., 1.8~2.6 psi), by which size distribution becomes wider (>5% CV) at higher gas pressure (e.g., >2.8 psi). Monodisperse microbubbles having a CV of 5% or less may be achieved by adjusting the flow rates of the flow rate of gas ($Q_g$) and continuous phase ($Q_c$) using $V_b$ ($f \propto Q_g \times Q_c$ and $V_b \partial (Q_g/Q_c)^{0.52} Ca^{-0.29}$). For identifying how two-phase flow resistance adjusts the flow rate variation, the microbubble diameter changing can be plotted at two representative FFGs, including d-FFG (largest microbubble generation) and h-FFG (smallest microbubble generation). From this plot, it is possible to identify ranges for decreasing (regime I) and increasing (regime II) the microbubble size variation.

Two-phase flow resistance can be altered by the Ca, corresponding to the pressure drop caused by end caps of microbubbles, thin film, and gutters flow at covers of microbubble filled channel. For example, the microbubble size is sensitive to function of flow rate ratio at relatively low Capillary number (hereafter "Ca") (e.g., Ca=0.005), resulting to wide distribution of microbubble size. Polydisperse microbubbles may become insensitive with increasing the Ca.

Figure 12B:
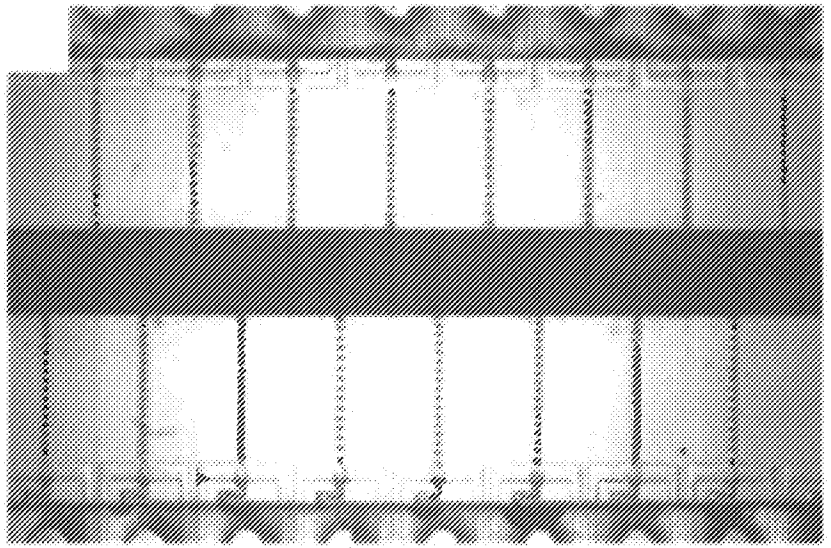
FIG. 12B is an image of a 3D MED device having a design in accordance with FIG. 12A.
Figure 12A:
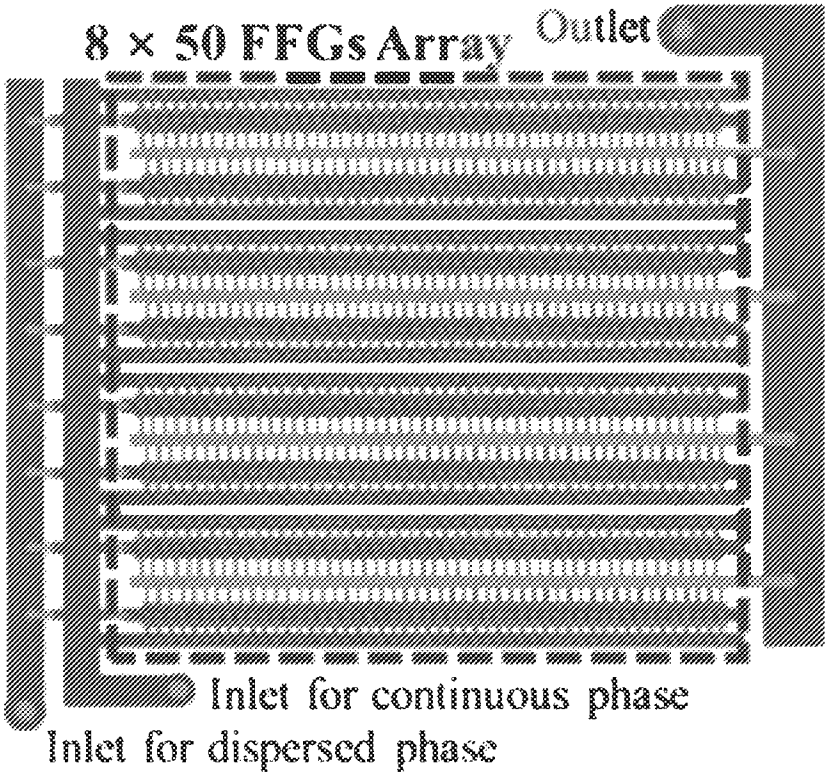
FIG. 12A is a schematic of a ladder-form 3D MED design containing 8 rows by 50 columns of FFGs in accordance with aspects of the present invention.
Figure 12C:
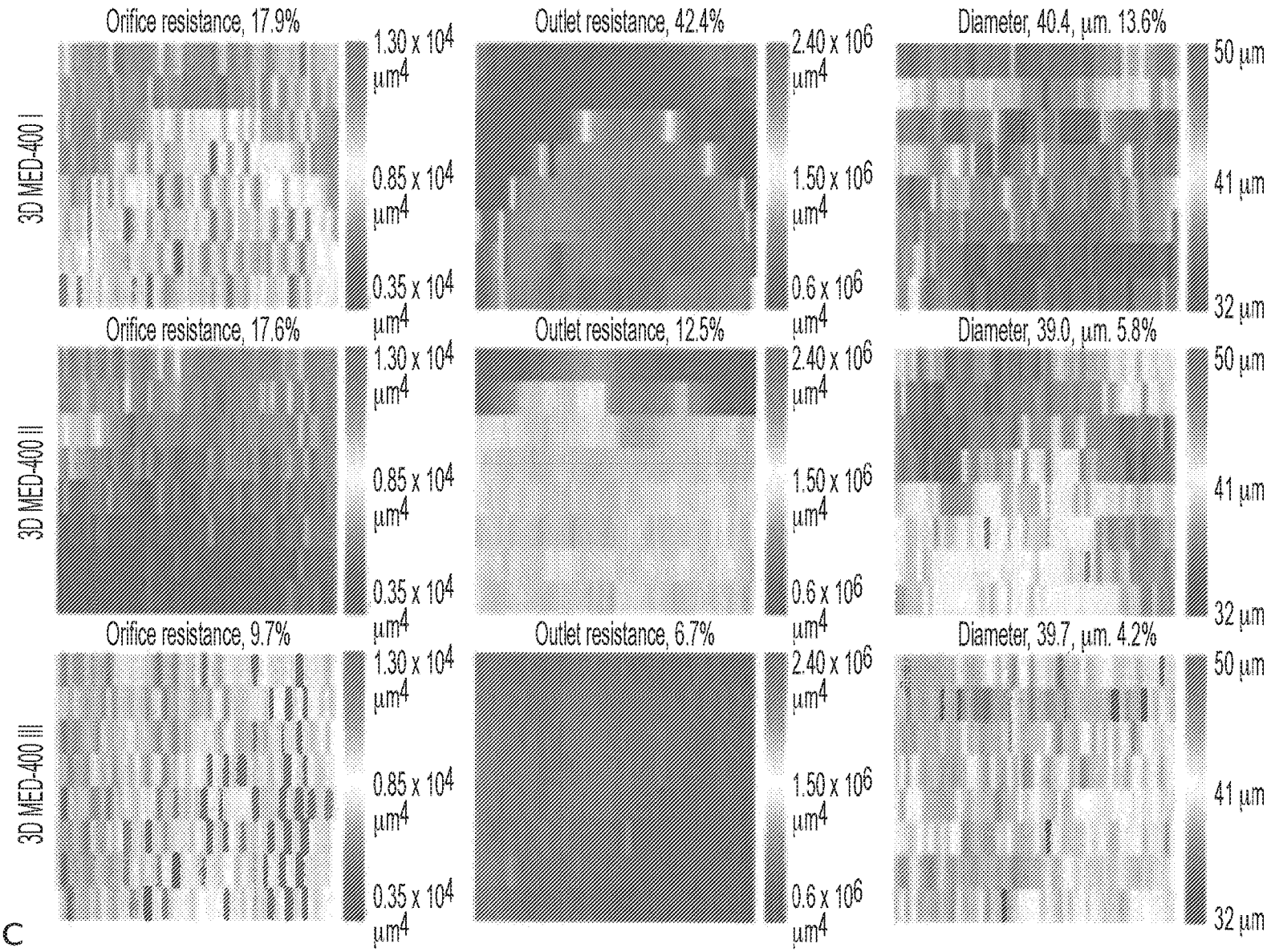
FIG. 12C is an image illustrating heat maps, color scale corresponding to FFGs array, illustrating channel resistance variation at orifice and outlet channels for three embodiments, 3D MED-400 I, II, and III, of the 3D MED design of FIG. 12A.

An optimal viscosity ratio (e.g., <0.0017 $u_d/u_c$) may be achieved to produce monodisperse microbubbles when $Ca_{avg}$ is fixed (see, e.g., FIG. 12C). In one embodiment, high value of viscosity ratio (e.g., $u_d/u_c$=0.0113) shows wider range of monodisperse regime (e.g., 54.8 μm<$D_{avg}$<98.1) than relatively low viscosity ratio value (e.g., $u_d/u_c$=0.0017, 59.7 μm<$D_{avg}$<77.4).

Microfluidic devices using microdroplet generators may be configured, using the microfluidic characteristics discussed herein, to produce monodisperse microbubbles having a low CV. For example, the monodisperse microbubbles may have a CV of 5% or less, more preferably 4% or less, more preferably 3% or less, or more preferably 2.5% or less. In one embodiment, the optimum or lowest CV value is obtained at the transition point of two-phase flow resistance. Non-limiting examples of microfluidic devices using microdroplet generators configured for production of homogenous, monodisperse microbubbles and various characteristics thereof, including interactions of the configured characteristics, are illustrated in FIGS. 9A-19C.

EXAMPLES

The following examples are non-limiting embodiments of the present invention, included herein to demonstrate the advantageous results obtained from aspects of the present invention.

Example 1—Production of Microfluidic Device

A microdroplet generator was cast as a single-piece of elastomer, with complex three-dimensional channels for mass production of emulsion droplets. The microdroplet generator was fabricated using a multi-height hard master plate and a soft master plate. The alignment of features between the two masters was not difficult because the feature sizes that require alignment are fairly large (>300 μm). Zero of the twenty attempts to align the two masters failed, illustrating the high reliability and robustness of this process. The softness of the top master allows for conformal contact between the patterned features of the two masters. Scanning electron microscopy (SEM) showed (e.g., FIGS. 3B-3C) that a three dimensional microfluidic device with well-aligned channels is formed via the processing techniques described above. The bottom side of the microdroplet generator shows that the through-holes are in perfect or about perfect registry with flow focusing generator, as seen in FIG. 3B-3C.

A pressure of over 20 kPa was applied during the curing process to form unobstructed pathways between distribution channels and through-holes. The cross-sectional SEM images, as seen FIG. 3B, illustrate that through-holes are aligned with the distribution channels and that no blockages between these two conduits occurred. Also, minimal height variations (<22 μm) in the patterns of the hard master as well as the silanization of the two masters with fluorinated silane facilitated conformal contact between features on the two masters by inducing the dewetting of PDMS prepolymer from the uppermost surface of the two masters.

The microdroplet generator had a width, a height, and a length for each delivery channel that was 0.5 mm, 0.7 mm, and 37 mm, respectively. The delivery channels 134 for oil (hexadecane), water, and resulting emulsions in each focusing generators 120 have the following dimensions: oil channel wf=40 μm, lf=1530 μm, hf=18 μm; water channel wf=30 μm, lf=140 μm, hf=18 μm and outlet channel 192 wf=50 μm, lf=380 μm, and hf=18 μm. Based on these channel dimensions and Equation (1), it is possible to connect up to Nf=1562 focusing generators 120 to each set of one or more continuous phase delivery channel 134*b* and one or more dispersed phase delivery channel 134*a*. Based on the resistance balance over the output connections and because the outlet channel (wo=300 μm, lo=3600 μm, ho=500 μm) is of a lesser height than the continuous delivery channel (e.g., oil) and the dispersed delivery channels (e.g., water), the number of focusing generators per each row channel (Nf) was calculated to be preferably less than 482 to satisfy the design constraints. Based on these estimations, 50 flow focusing generators were included in each delivery channel, which easily satisfy the design constraint.

Figures 4A, 4B, 4C, 4D, 4E:
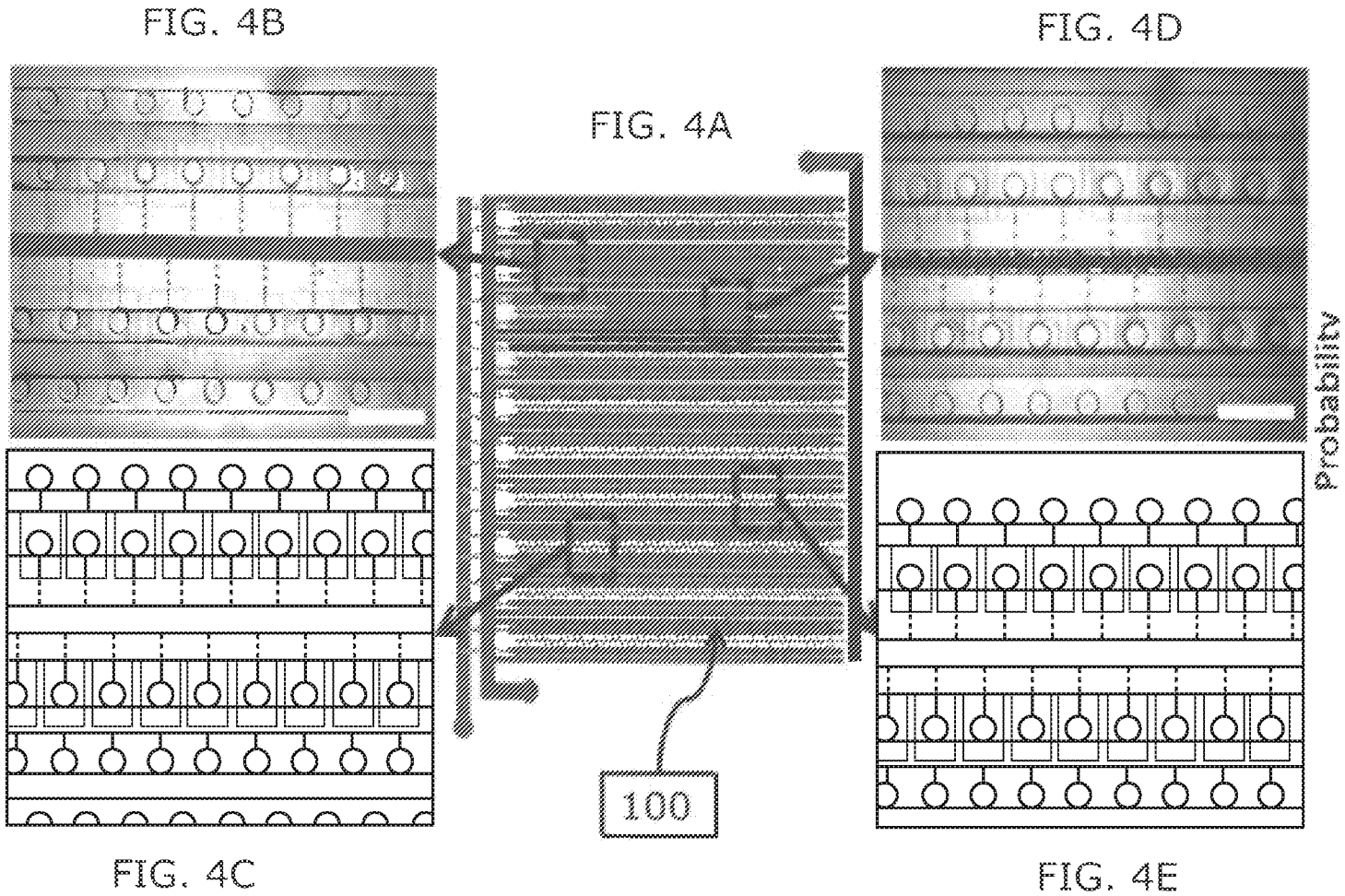
FIG. 4A is a schematic illustration of a microdroplet generator in accordance with aspects of the invention.
FIGS. 4B-4E are perspective views of portions of the microfluidic device depicted in FIG. 4A.

The inventors tested the generation of W/O emulsion by using pressure driven flow (FIG. 4). For a W/O emulsion, the flow rates were set to 1.5 L/hour for the aqueous phase and 3.0 L/hour for the oil phase. The inventors confirmed that droplets were generated in all of the flow focusing generators (e.g., FIG. 4A), and that the rate of droplet formation in the entire device was ~8.73×106 droplets per sec. The droplets had an average diameter of d=45.0 μm with a coefficient of variance (CV) of 6.6%, as seen in FIG. 5.

The size of emulsion droplets can be changed by varying the ratio of the flow rates of oil and aqueous phases. For example, by changing the oil phase flow rate from 3.4 to 2.8 L/hr while keeping the flow rate of the aqueous phase constant at 1.5 L/hr, the average droplet size changes from 36.2 to 51.2 μm, as seen in FIG. 8. Additionally, it was confirm that droplets were generated in all of the flow focusing generators. The generated droplets were monodisperse with the coefficient of variation (CV) as low as 6.6% when the average droplet diameter was 45.0 μm, and rate of droplet formation in the entire device was ~$8.73\times10^6$ droplets per sec (~>30 billion droplets per hr). In FIG. 8, red, black and blue histograms represent droplet size distributions obtained at Qa/Qo of 0.40, 0.50 and 0.55, respectively.

Example 2—Fabrication of Microdroplet Generator for Microbubble Production

A microfluidic device having a microdroplet generator was produced using a facile fabrication method the eliminates the need for aligning and bonding multiple pieces of elastomer to produce a three-dimensional monolithic elastomer device (3D MED). The 3D MED is fabricated by double-sided imprinting using hard silicon master and soft PDMS master. To prepare the multi-height hard master by photo-lithography, negative tone photoresist SU-8 was first spin-coated at 4000 rpm onto a Si wafer. A photomask that included the patterns for the FFGs and underpasses for the dispersed phase was used to selectively expose UV onto the spin-coated SU-8. For the second layer, SU-8 of 600 um thickness was spin-coated onto the first layer SU-8. A second photomask that consisted of the through-holes and collection channel was aligned to the first layer using a mask aligner (ABM3000HR) and then UV exposure was performed. The multi-height SU-8 patterns was formed by removing the unexposed regions of the photoresist in SU-8 developer. The obtained SU-8 patterns on Si wafer served as a hard master. Two main fabrication tolerances were found depending on the spin-coating SU-8 and UV exposure condition, resulting in non-uniform channel height (3D MED-400 I) and width (3D MED-400 II). For example, if a small amount of SU-8 compared to Si wafer size is used, ring patterns are formed onto spin-coated SU-8, which induce a large variation of height, as shown in FIG. 18E. To solve non-uniform pattern height, the spin-coating was performed on the condition that SU-8 photoresist was fully covered with 4 inch Si wafer area. Also, 30 minutes was allowed to pass before soft-baking SU-8. In addition to spin-coating condition, large width variation with gradually decreasing patterns was found, which is correlated to non-uniform UV intensity on large area. When UV was exposed over an optimal irradiation time (e.g., 6 sec), a non-uniform channel width for orifice channel was produced, as shown in FIG. 18E. Thus, the uniform channel dimension was achieve by applying the optimal spin-coating condition and UV exposure time (e.g., 4 sec) as shown in FIG. 18E. Conventional single-layer photolithography was used to make the PDMS soft master. SU-8 photoresist was spin-coated and UV exposed through a photomask to develop patterns. The two Si master are silanized with tridecafluoro-1,1,2,2-tetrahydrooctyl-1-trichlorosilane. PDMS mixed with cross-linker in the ration 10:1 was poured on the Si master with single-layer SU-8 pattern and cured at 95° C. for 2 hours and then peeled off to obtain the PDMS soft master mold. The PDMS soft master was subsequently silanized after plasma treatment for 2 min.

To fabricate the complete 3D MED, uncured PDMS mixed with the cross-linker in the ratio 10:1 was poured onto both PDMS soft master mold and SU-8 hard master. After removing gas microbubbles in a vacuum chamber, sift and hard master were aligned with the aid of support patterns on both masters. After alignment between master molds, PDMS was cured on a hotplate at 65° C. over four hours by applying a pressure (50 kPa) on the soft master. To maintain the alignment between the two masters and apply uniform pressure across the entire device during PDMS curing, a hard acrylic plate was placed on top of the soft master and four binder slips were used. The uniform pressure application is important to obtain the uniform dimension of distribution channel. When non-uniform pressure is applied by pressing the only one side edge of soft master over 50 kPa, non-uniform distribution channels are formed as shown FIG. 19A. The final 3D MED was obtained by peeling off the soft master and then completely peeling the remaining elastomer from the hard master. Subsequently, the top and bottom of 3D MED were plasma-bounded to thin (2 mm) and thick (1 cm) slabs of PDMS, respectively. Injection holes (0.75 mm in diameter) for the fluids were punched through the top PDMS slab using a stain-less steel punch, and a syringe needle (outer diameter=0.92 mm) connected to polyethylene tubing (inner diameter=0.86 mm and outer diameter=1.32 mm) was inserted to each hole. The bottom of the device was then bonded to a glass slide through plasma treatment. To identify the fabrication tolerance for final 3D MED, the FFG heights were characterize by using optical surface profiler (Zygo NewView 7300). For photomask and channel of FFG widths and distribution channel variation, optical images were obtained using an upright microscope (Carl Zeiss Axio Plan II) with a digital camera (AmScope MU1003-CK 10 MP) and then measured by using line profiling of ImageJ software (Figure S5B).

Example 3—Testing Gas Microbubble Generation Using 3D MED

To test parallel microbubble generation using 8 FFGs, nitrogen gas and poly(vinylalcohol) (PVA, 87-90% hydrolyzed, average molecular weight: 13,000-23,000 g/mol, Sigma-Aldrich) solution was use as shown in Table 1, below.

TABLE 1

Physical properties of solution used in experiments

| Solution | Surface tension, σ ($mNm^{-1}$) | Viscosity, μ (mPa s) |
|---|---|---|
| Nitrogen gas | — | 0.018 |
| Pure water | 72.0 | 0.97 |
| 2 wt % PVA | 47.9 | 1.59 |
| 5 wt % PVA | 46.5 | 3.55 |
| 10 wt % PVA | 45.9 | 10.4 |
| Hexadecane (2 wt % Span 80) | 5.0 | 4.1 |

First, PVA solution was injected using a syringe pump and then nitrogen gas was introduced and controlled using a pressure regulator. For W/O liquid emulsion generation, D.I. water was used as the dispersed phase and hexadecane solution with 2 wt % Span 80 as the continuous phase. To mass produce the gas microbubbles, pressure driven flow was used by applying pressure to solution filled stainless steel pressure vessels (One gallon, Alloy Products Corp.) for the continuous phase which can maintain uniform and high flow rate. To generate a gas-in-water (G/W) microbubbles, a 3D MED was filled with continuous phase (2 wt % PVA in D.I. water) until trapped bubbles were completely removed. Subsequently, the nitrogen gas was introduced to form a G/W microbubbles. The flow rates of the two-phases arweree controlled using pressure regulators. The maximum pressures of 25 psi and 40 psi could be applied to feed the dispersed and continuous phases, respectively. The diameter of produced microbubbles ($D_{pancake}$) within the channel was measured using optical microscopy (Nikon Diaphot 300 Inverted Microscope) and analyzed using ImageJ. To convert the pancake shape of volume ($V_{pancake}$) in the rectangular channel to the microbubble sphere diameter ($r_{sphere}$), the following equation was used, $$V_{pancake} = \frac{\pi h^3}{6} + \frac{\pi h}{4}(D_{pancake} - h)\left(\frac{\pi h}{2} + D_{pancake} - h\right) = \frac{4}{3}\pi r_{sphere}^3.$$

The individually measured height of outlet channels was applied for estimating microbubble diameter and coefficient variation (CV).

Example 4—Effect of Microchannel Ratio

Regarding microbubble production, the present inventors examined the effect of channel resistance ratio. Two different 3D MEDs were fabricated with different resistance ratios, both which satisfied Equation 1 (discussed above). Table 2 provides dimensions for the 3D MEDs.

TABLE 2

Microchannel dimension for 3D MED with 8 parallel FFGs

| | Distribution Channel | | | FFG for dispersed phase | | | | |
|---|---|---|---|---|---|---|---|---|
| | Length, $l_d$ (μm) | Width, $w_d$ (μm) | Height, $h_d$ (μm) | Channel | Length, $l_f$ (μm) | Width, $w_f$ (μm) | Height, $h_f$ (μm) | Resistance Ratio $2N(R_d/R_f)$ |
| 3D MED-8 I | 700 | 512 | 320 | Injection | 360 | 85 | 79 | $7.31 \times 10^{-3}$ |
| | | | | Orifice | 30 | 24 | | |
| | | | | Outlet | 950 | 65 | | |
| | | | | | 1130 | 200 | | |
| 3D MED-8 II | 700 | 512 | 970 | Injection | 360 | 85 | 79 | $0.96 \times 10^{-3}$ |
| | | | | Orifice | 30 | 24 | | |
| | | | | Outlet | 950 | 65 | | |
| | | | | | 1130 | 200 | | |

Figure 10B:
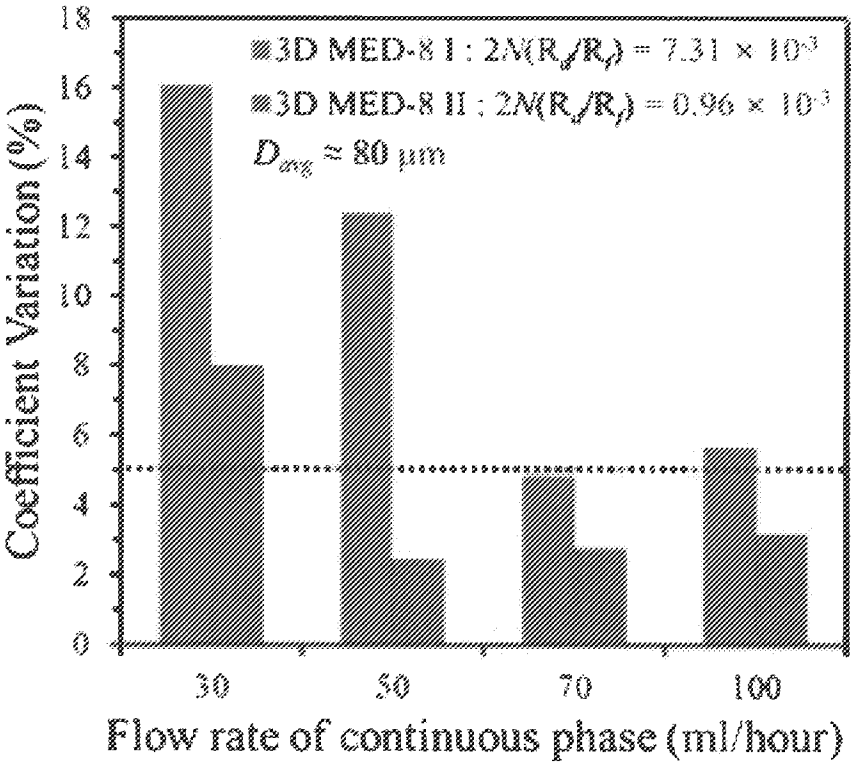
FIG. 10B is a graph illustrating size distribution of microbubble diameters generated in the 3D MED-8 I and II of FIG. 10A as the flow rate varies for the continuous phase of 2 wt % PV.
Figure 10A:
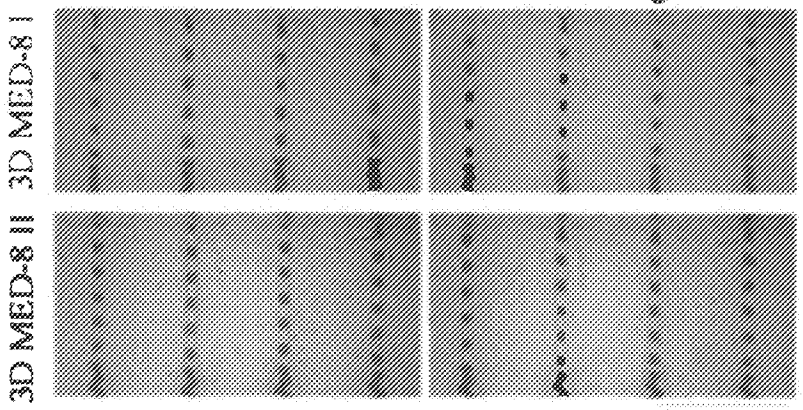
FIG. 10A is an image of parallel microbubble generation in two 3D MED-8 with different channel resistance ratios in accordance with aspects of the invention.

Nitrogen gas and 2 wt % PVA were used for testing the parallel microbubble generation in the 3D MED-8 I and II. As shown in FIG. 10A, the interconnected 8-FFGs stably generated the gas microbubbles in the both 3D MEDs. The CV values for microbubble size were estimated at the outlet channel of 8-FFGs. The size distribution of microbubbles generated in two different channel resistance ratio were compared for a measured 80 μm average microbubble diameter at varying flow rates of continuous phase (FIG. 10B). In general, the CV values in 3D MED-8 I ($2N_f(R_d/R_f)=7.31\times10^{-3}$) are higher than 3D MED-8 II ($2N_f(R_d/R_f)=0.96\times10^{-3}$) at all flow rates examined. Although channel resistance ratio for 3D MED-8 I satisfy the Equation 1, monodisperse microbubbles (<5% CV) were generated at 70 ml/hour flow rate, which indicate that uniform flow rate can be achieved in specific flow rate and much lower microchannel resistance ratio value than Equation 1. These finding support that non-uniform flow rates originate from tolerance of microchannel dimension, thus we can suggest the design criterion with $2N(R_d/R_f)<0.001$ under the microchannel resistance variation (12.4% CV for orifice channel resistance and 6.5% CV for outlet channel resistance in the our case).

Example 5—Effect of Two-Phase Flow Resistance

Figure 11A:
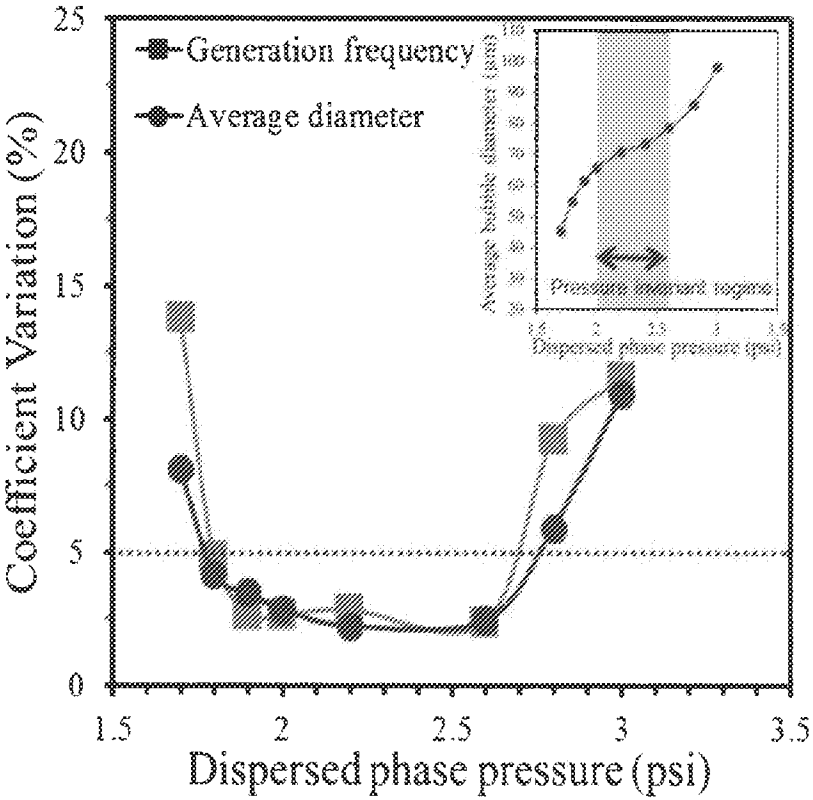
FIG. 11A is a graph illustrating changes in the coefficient variation for microbubble diameter and generation frequency as a function of gas pressure for a given 50 ml/hr flow rate of continuous phase (2 wt % PVA) using the 3D MED-8 II of FIG. 10A.
Figure 11B:
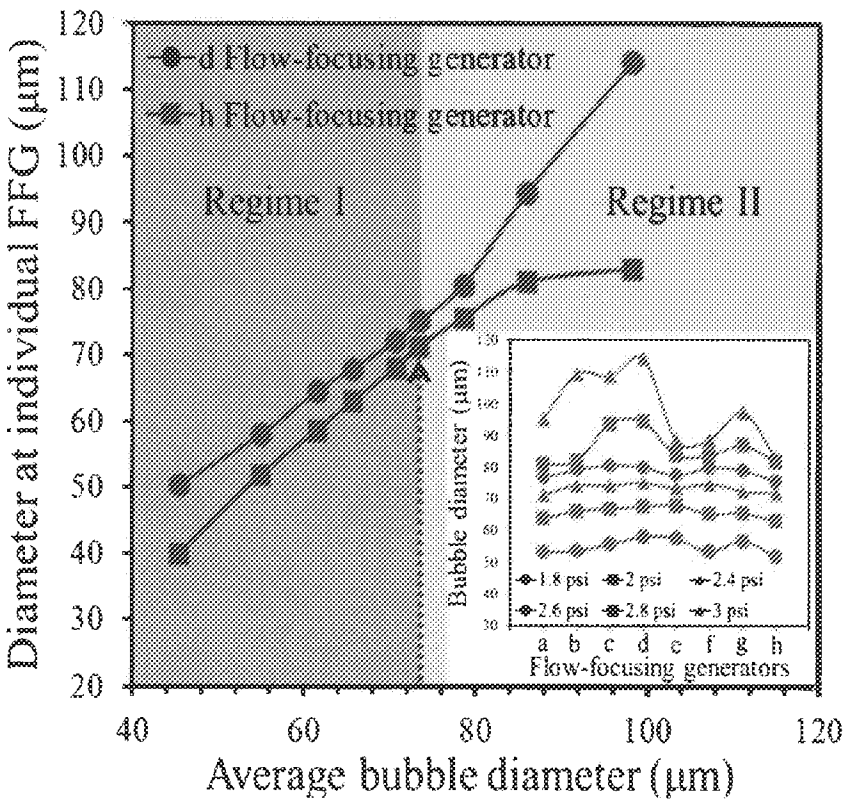
FIG. 11B is a graph illustrating the microbubble diameter changes at the two representative microbubble droplet generators (largest and smallest microbubble generation at d- and h-FFG) among the 8-FFGs of FIG. 10A.

To experimentally evaluate the fluid distribution affected by the two-phase flow resistance, the parallel microbubble generation using the 3D MED-8 II with microchannel dimension variation (FIGS. 11A-11D) was tested. Firstly, the CV values for microbubble generation frequencies and diameters as gas pressure were characterized for a given 50 ml/hour flow rate (FIG. 11A). The gas phase pressure was changed to find the effect of microbubble size/number in outlet channels on the two-phase flow resistance. The average microbubble diameter showed nonlinear behavior with gas pressure, existing insensitivity regime to gas pressure (FIG. 11A). For size distribution at low gas pressure (1.7 psi), each FFG can generate different size of microbubbles (8.2% CV, $D_{avg}$=45.4 μm) at different frequencies (13.8% CV, $f_{avg}$=1312 $5^{-1}$). The frequency of microbubble generation f and microbubble volume $V_b$ ($f \propto Q_g \times Q_c$ and $V_b \propto (Q_g/Q_c)^{0.52}Ca^{-0.29}$) is significantly related to the flow rate of gas ($Q_g$) and continuous phase ($Q_c$). Therefore, flow rates ratio between dispersed and continuous phase are non-uniform. Due to random microchannel dimension variation, flow rate variation between FFGs may be intrinsic even though channel resistance ratio is sufficiently high, resulting in polydisperse microbubble size (>5% CV). Interestingly, the present inventors discovered that monodisperse microbubbles (<5% CV) are generated at uniform generation frequencies (<5% CV) in specific range of gas pressure (1.8~2.6 psi), and then size distribution become wider (>5% CV) at higher gas pressure (>2.8 psi). These results indicate that the random flow rate variation may be adjusted by increasing the gas pressure, which changes the microbubble size/number in their outlet channels. This adjustment behavior for random microbubble size variation can be attributed by the two-phase flow resistance at each outlet channels.

Further, the microbubble diameter changing at two representative FFGs, including d-FFG (largest microbubble generation) and h-FFG (smallest microbubble generation) among 8-FFGs (FIG. 11B), was plotted to identify how two-phase flow resistance adjust the flow rate variation. From this plot, a transition point for decreasing (regime I) and increasing (regime II) the microbubble size variation was identified. At 49.2 μm average microbubble size in the regime I, two different smallest and largest size of microbubbles (50.4 μm at d-FFG and 40.0 μm at h-FFG) were generated at different generation frequencies (1.55 kHz and 1.10 kHz). By increasing the average microbubble size, however, microbubble sizes gap between d- and h-FFGs became narrow until 73.1 μm average microbubble size (75.0 μm at d-FFG and 71.2 μm at h-FFG), indicating that flow rates were almost uniform. After that, the microbubble size gap in regime II rapidly widened when the average microbubble diameter is increased over 75.5 μm. These results were consistent with hydrodynamic resistance for two-phase flow. The two-phase flow resistance showed two different regimes as function of volume fraction and/or length to width ratio, including increasing (regime I) and decreasing (regime II) the hydrodynamic resistance. The d-FFG generated relative large volume fraction and size of microbubbles that have relatively high resistance, which shows lower increasing rate of microbubble size as gas pressure compared to h-FFG. Thus, microbubble size variation can be adjusted by two-phase flow resistance variation until the transition position that has a highest hydrodynamic resistance. In contrast, d-FFG was first to reach the regime II, such that decreased two-phase flow resistance as a function of microbubble size and volume fraction, resulted in high increasing rate of microbubble diameter at the d-FFG. Thus, it is demonstrated that random flow rate variation is adjusted by two-phase flow resistance, resulting in monodisperse microbubble generation in parallel FFGs.

Figure 11C:
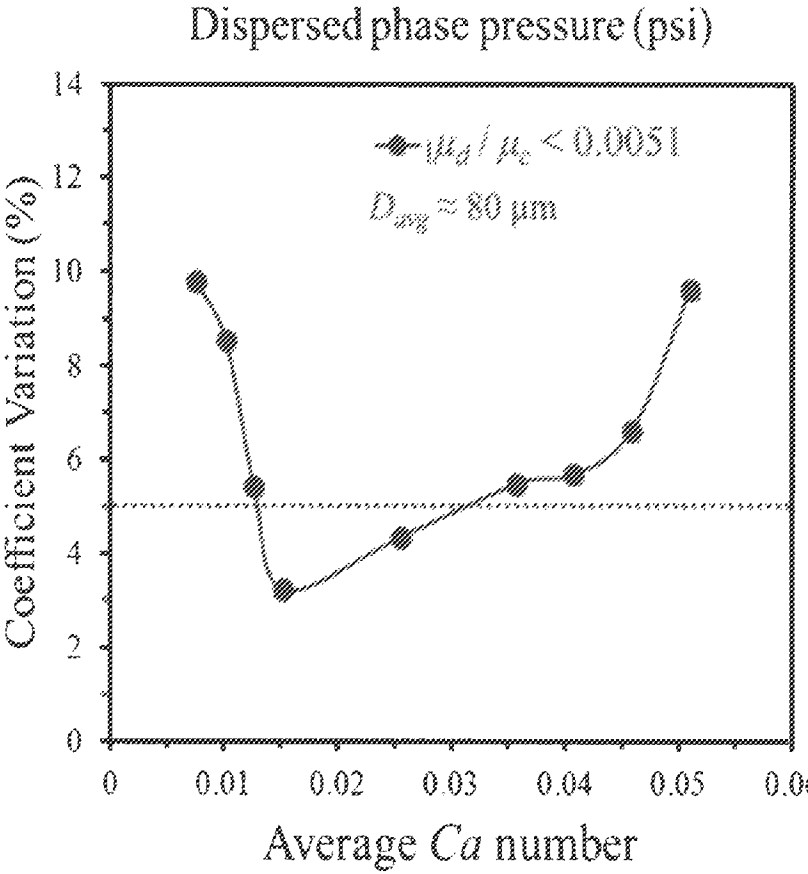
FIG. 11C is a graph depicting hydrodynamic resistance related to two-phase flow resistance by alternating the viscosity ratio of the 3D MED-8 of FIG. 10A.
Figure 11D:
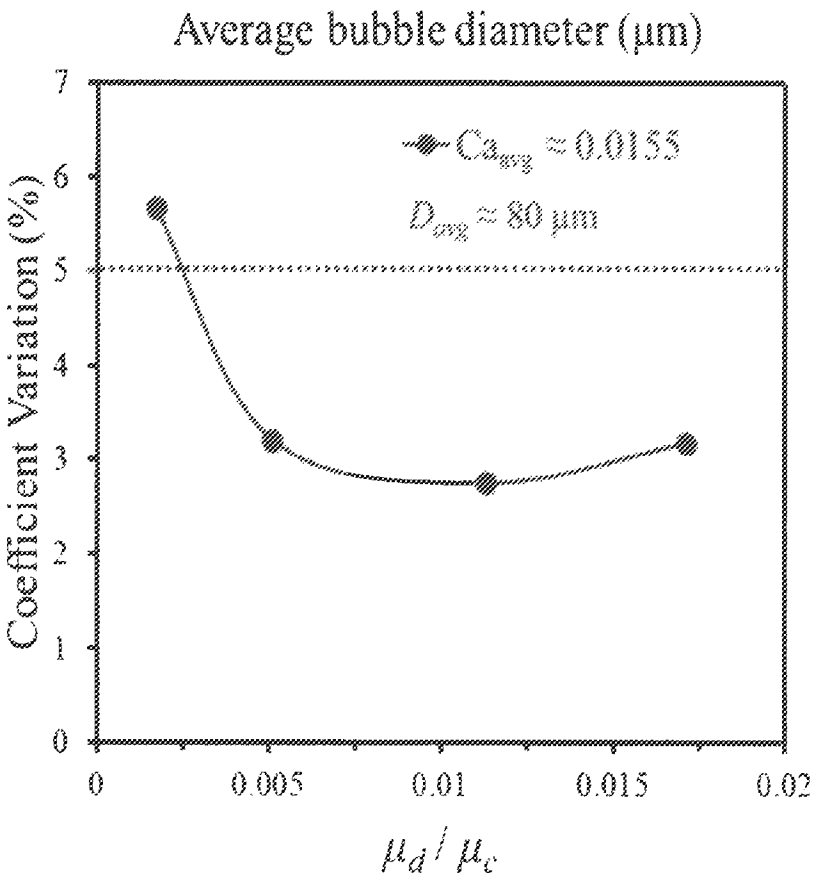
FIG. 11D is a graph depicting hydrodynamic resistance related to two-phase flow resistance by alternating the viscosity ratio for the 3D MED-8 of FIG. 10A.

Example 6—Effect of Capillary Number and Viscosity Ratio for Parallel Microbubble Generation Considering that gas break-up occurs in the two-phase fluids, force balances between surface tension and viscosity at the boundary can be understood using Capillary number (hereafter "Ca"), $Ca=\mu_c U/\sigma$, where $\mu_c$ and U is viscosity and mean velocity of the continuous phase, and σ is the surface tension between dispersed and continuous phase. After microbubble generation, two-phase flow resistance can be altered by Ca, corresponding to the pressure drop caused by end caps of microbubble, thin film and gutters flow at covers of microbubble filled channel. At a given viscosity ratio ($u_d/u_c$=0.0051, 5 wt % PVA), as shown in FIG. 11C, monodisperse microbubbles (<5% CV) was generated in a specific range of $Ca_{avg}$ ($0.0127<Ca_{avg}<0.0358$).

Figure 15:
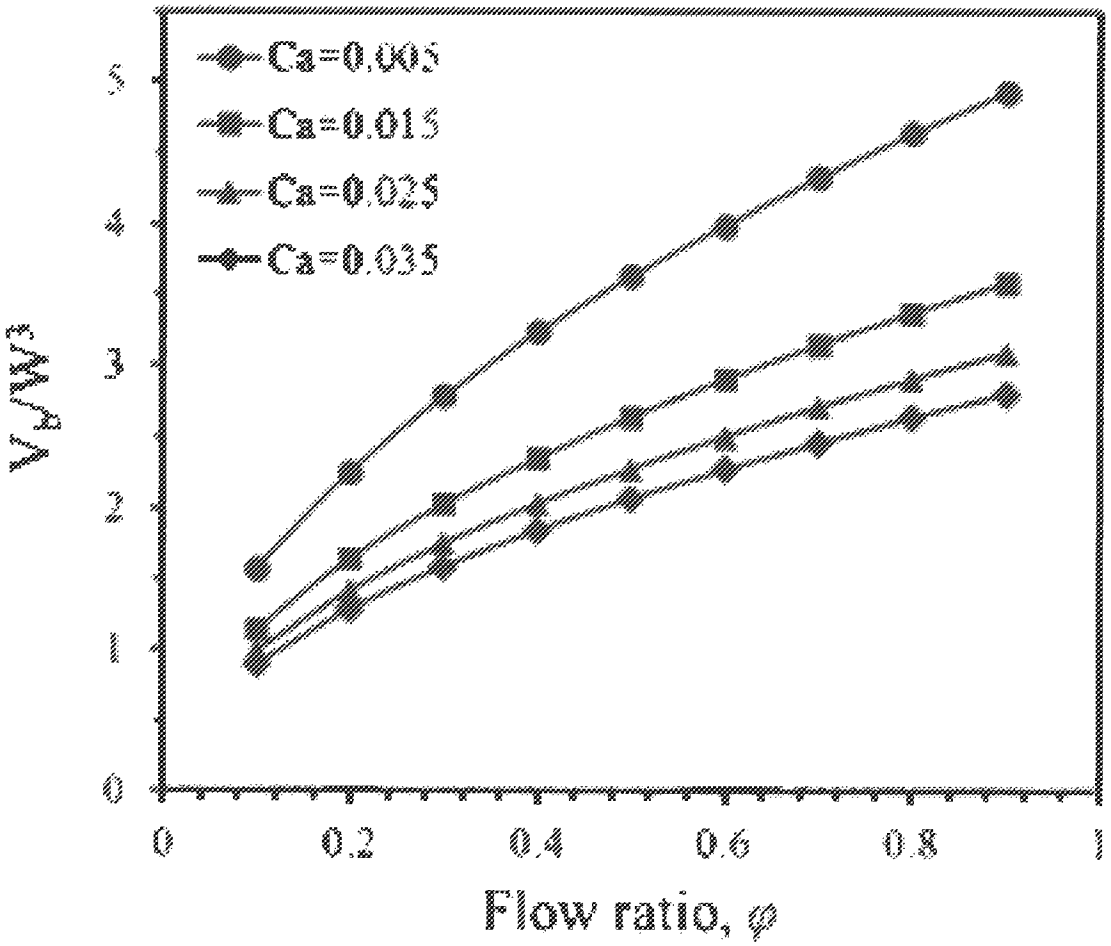
FIG. 15 is a graph illustrating simulation results for varying microbubble size as compared to capillary number and flow rate ratio according to aspects of the present invention.

The results of the experiment illustrate that specific ranges of microbubble diameter having uniformity (e.g., <5% CV), may be changed by varying the $Ca_{avg}$ (Figure S1A-C). The reason for polydisperse microbubbles at low $Ca_{avg}$ can be expected from simulation of microbubble size as varying flow rate ratio and Ca using the $V_b/w^3=1.12\varphi^{0.52}Ca^{-0.29}$. From the predicted volume of the microbubble as shown in FIG. 15, it was found that changing microbubble size is sensitive to function of flow rate ratio at relatively low Ca (Ca=0.005), resulting in wide distribution of microbubble size. At over 0.0358 $Ca_{avg}$, polydisperse microbubbles were observed even though microbubble volume became insensitive with increasing the Ca. This behavior is consistent with two-phase flow resistance, which is inversely proportional to the Ca number due to thickened liquid film between moving microbubble and channel wall. As a result, the low two-phase resistance, due to high Ca number, is not able to adjust flow rate variations originating from variations in the dimensions of the microchannel.

Figure 14A:
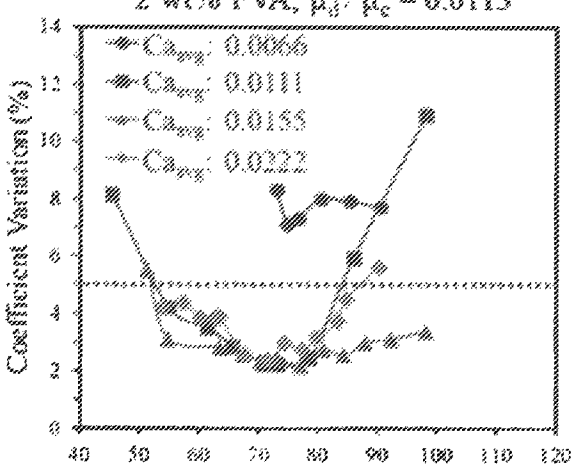
FIGS. 14A-14C are graphs illustrating the effect of capillary number for monodisperse microbubble regimes at fixed viscosity ratio ($\mu_d/\mu_c$) of 0.0113, 0.0051, and 0.0017, respectively, for the 3D MED-8 II embodiment of FIG. 12C.
Figure 14B:
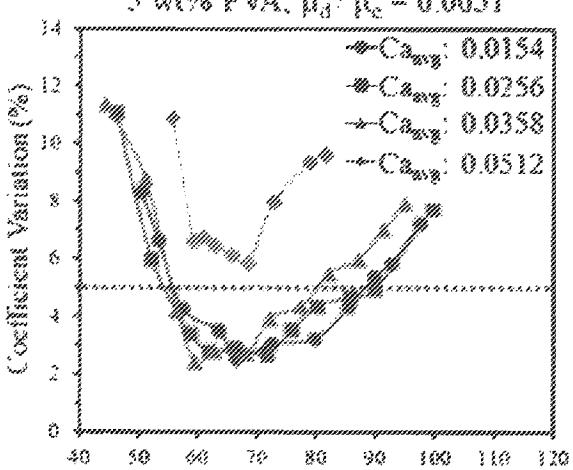
Figure 14C:
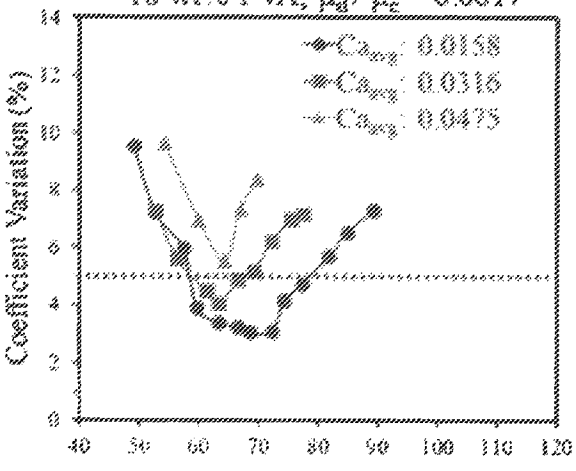
Figure 14D:
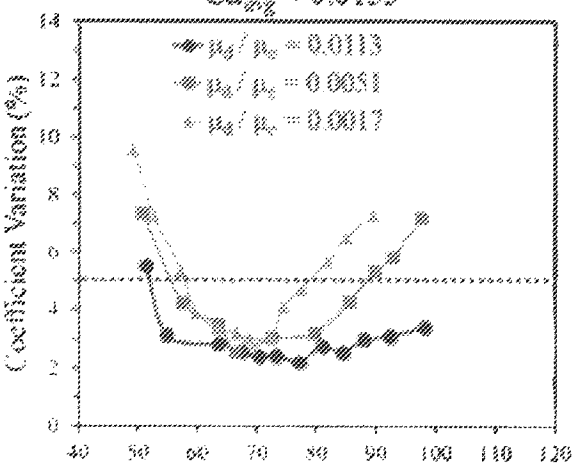
FIG. 14D is a graph illustrating a change in monodisperse microbubble generation regime as a function of viscosity ratio, for a given $Ca_{avg}\approx 0.0155$, for the 3D MED-8 II embodiment of FIG. 12C.

In addition to Ca number, the optimal viscosity ratio (e.g., <0.0017 $u_d/u_c$) was found when for monodisperse microbubbles when $Ca_{avg}$ was fixed (FIGS. 12A-12C). High values for viscosity ratio ($u_d/u_c$=0.0113) exhibited a wider range for the monodisperse regime (e.g., 54.8 μm<$D_{avg}$<98.1) than relatively low viscosity ratio values (e.g., $u_d/u_c$=0.0017, 59.7 μm<$D_{avg}$<77.4), as shown in FIG. 14D. The largest and smallest microbubble sizes from the 8-FFGs were also plotted to identify the effect of viscosity ratio at fixed $Ca_{avg}$ number (FIGS. 16A-16D). In fact, the slope, corresponding to the linear decrease of hydrodynamic resistance in regime II, was altered as the viscosity ratio at fixed Ca number, and this slope was not changed as function of Ca number at fixed viscosity ratio. Consistent with changing two-phase flow resistance as viscosity ratio, relatively low viscosity ratio value ($u_d/u_c$=0.0017) lead to more rapid gab widening between d- and h-FFG in the regime II compared to high viscosity ratio ($u_d/u_c$=0.0113). Considering the small average microbubble size (around 50 μm) that is smaller than the width (65 μm) and height (80 μm) of channel, variation between largest and smallest microbubble sizes was larger in high viscosity continuous phases ($u_d/u_c$=0.0017) as compared to low viscosity continuous phases ($u_d/u_c$=0.0113). Under these conditions, two-phase flow resistance may be considered not to have a significantly different flow resistance as compared to single-phase flow resistance because volume fraction and frictional forces for moving microbubbles are minimal; thus, single-phase flow resistance may be considered to dominate the fluids distribution. Per Equation (1) for the hydrodynamic resistance of the single-phase flow, high viscosity can induce the large variation of hydrodynamic resistance by channel dimension variation compared to the lower viscosity. The following viscosity ratio values were achieved individually: 5.5% ($D_{avg}$: 51.4 μm), 7.3% ($D_{avg}$: 50.5 μm), and 9.6% ($D_{avg}$: 49.2 μm) CV values at 0.0113 (2 wt % PVA, μ: 1.59 mPs·s), 0.0051 (5 wt % PVA, μ: 3.55 mPs·s), and 0.0017 (10 wt % PVA, μ: 10.4 mPs·s) (FIG. 16D). Additionally, it was observed that microbubble size variations were diminished with increasing the average microbubble size in regime I, which lead to increasing the hydrodynamic resistance as a function of microbubble size. Due to a high two-phase flow resistance observed for a viscosity ratio value of 0.0017, variation gap is rapidly decreased and CV value obtains 3.2%. Thus, the uniform fluid distribution for generation of monodisperse microbubbles was achieved by considering additional hydrodynamic resistance from two-phase flows that are dependent on both $Ca_{avg}$ numbers and viscosity ratio.

Example 7—Testing Liquid Emulsion Generation Using 3D MED-8 II

Compared to the liquid emulsion generation, the gas phase for microbubble generation has unique properties including low viscosity/density, high surface tension to liquid solution, and high compressibility. Accordingly, the present inventors conducted experimentation regarding liquid emulsions using the 3D MED-8 II microfluidic device.

Figure 17:
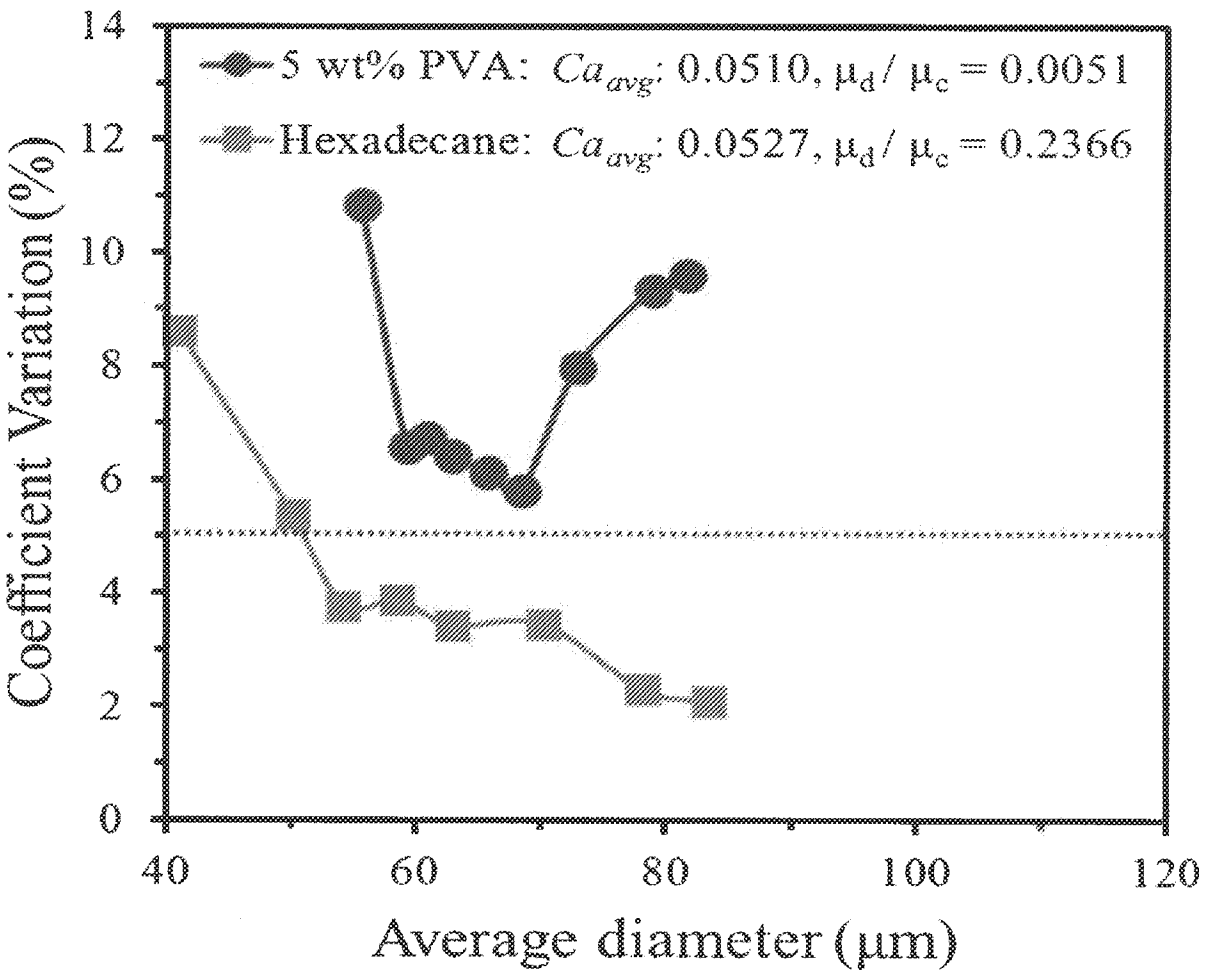
FIG. 17 is a graph comparing gas microbubble and liquid emulsion generation in 8 parallel FFGs for a given similar average capillary number according to aspects of the present invention.

To test the liquid emulsion generation using 3D MED-8 II, hexadecane (4.10 mPa s) solution was used for water-in-oil emulsion, which provides similar single-phase flow resistance as gas microbubble generation using 5 wt % PVA (3.55 mPa s). It was observed that monodisperse liquid emulsions were generated in wide range of average diameters (54.2~83.5 μm), whereas gas microbubbles were polydisperse (FIG. 17). Although two-phase flow resistance for liquid droplet moving less sensitive to microbubble size/volume than gas microbubbles due to high viscosity ratio values, flow rate variation was adjusted to have monodisperse droplets and a CV value maintained at below 5% until jetting behavior. This result supports the notion that gas phase distribution is very sensitive to hydrodynamic resistance variation due to high viscosity ratio and high compressibility. In certain cases, especially, if only the gas phase is flowing in the outlet channel due to clogging in the continuous phase channel, its hydrodynamic resistance, single-phase flow with extremely low viscosity, is much lower compared to other channels that generate gas microbubbles. As a result, hydrodynamic resistance variation becomes much larger, resulting in unstable and polydisperse microbubble generation.

Accordingly, as an alternative to ensuring identical dimensions for each of the microchannels—which is inherently very difficult using conventional fabrication because of intrinsic variations requiring fabrication tolerances—two-phase flow resistance can generate monodisperse microbubbles in parallel FFGs, dispite non-uniform flow rates due to variations in the microchannels.

Example 8—Tests for Scaling-Up Microbubble Production in 3D MED

Although the lowest CV value was achieved at the transition point of two-phase flow resistance, predicting and quantifying the two-phase flow resistance is difficult due to complex system dynamics associated with friction with channel surface, volume fraction, and thin lubrication films and corner gutter flow in rectangular channel. Accordingly, the present inventors tested microbubble generation using 8-FFGs as an alternative approach for identifying optimal conditions for obtaining monodisperse microbubbles for large-scale production of microbubbles.

Large-scale integration of FFGs is beneficial for enhancing the production rate of gas microbubble generation. A key feature of the ladder form distribution channel is that densely packed FFGs can be achieved in a small unit area, making it possible to minimize the microchannel tolerance. Accordingly, the 3D MED devices were designed to have a ladder form distribution connected to 400-FFGs, which enabled the use of a single-set injector (FIG. 12A). Each of the eight rows of the distribution channel was connected to 50-FFGs ($2N_f(R_d/R_f)<0.10\times10^{-3}$) and in communication with a single supply channel ($2N_d(R_s/R_{row})<0.35\times10^{-3}$), where $N_d$ is the number of distribution channels and $R_{row}$ ($\sim R_d/N_f$) and $R_s$ are channel resistance for distribution channel connected to $N_f$-FFGs and supply channel.

Figures 18A, 18B:
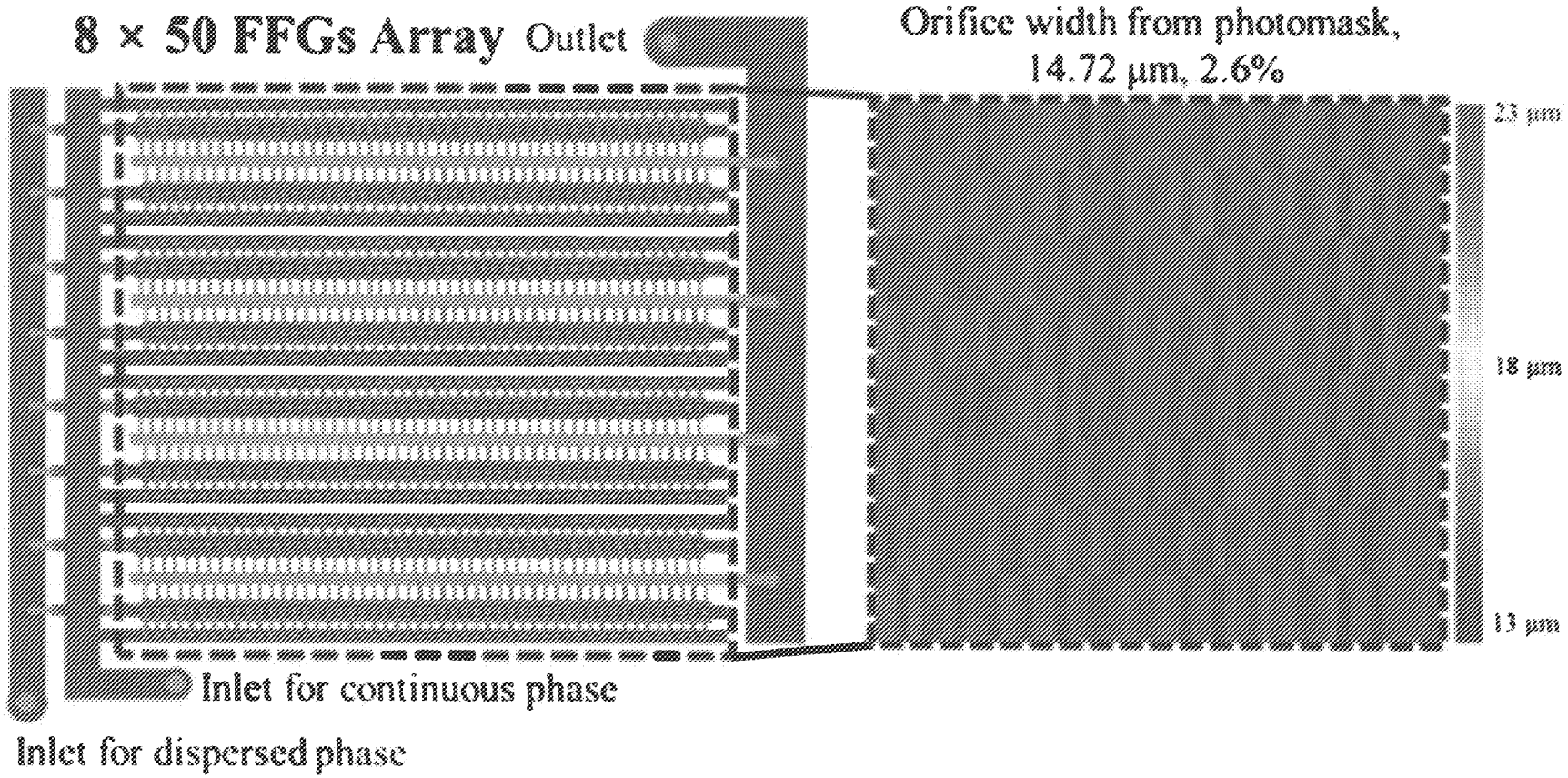
FIG. 18A is a schematic of a ladder-form 400 FFG integrated 3D MED design in accordance with aspects of the present invention.
FIG. 18B is an image of a heat map of the orifice width variation from photomask on the FFG array of FIG. 18A.
Figure 18D:
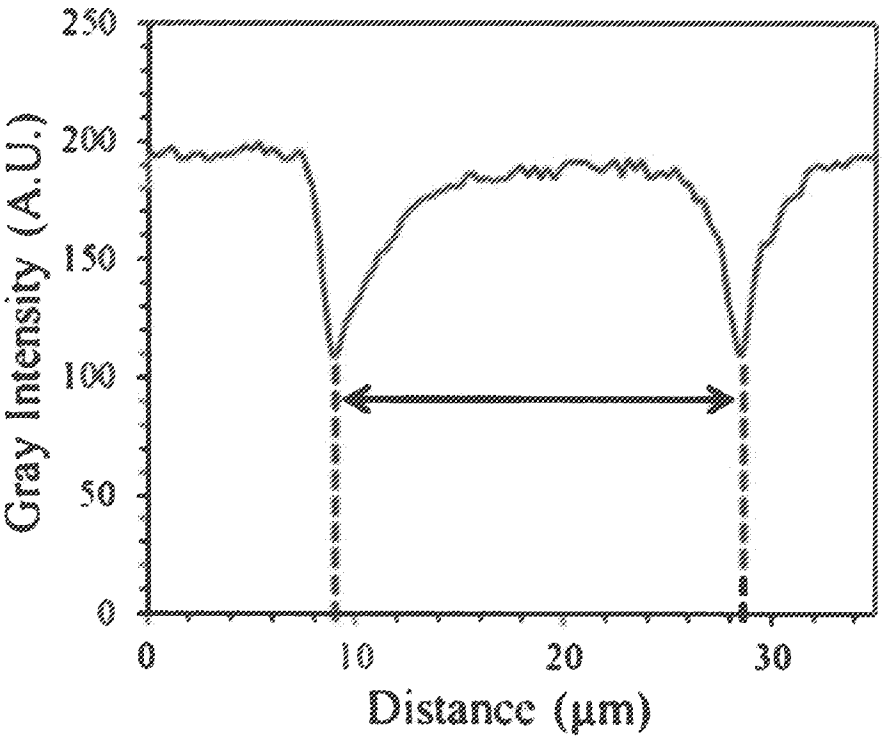
FIGS. 18C-18D illustrate the measurement of microchannel width of the 3D MED design of FIG. 18A.
Figure 18C:
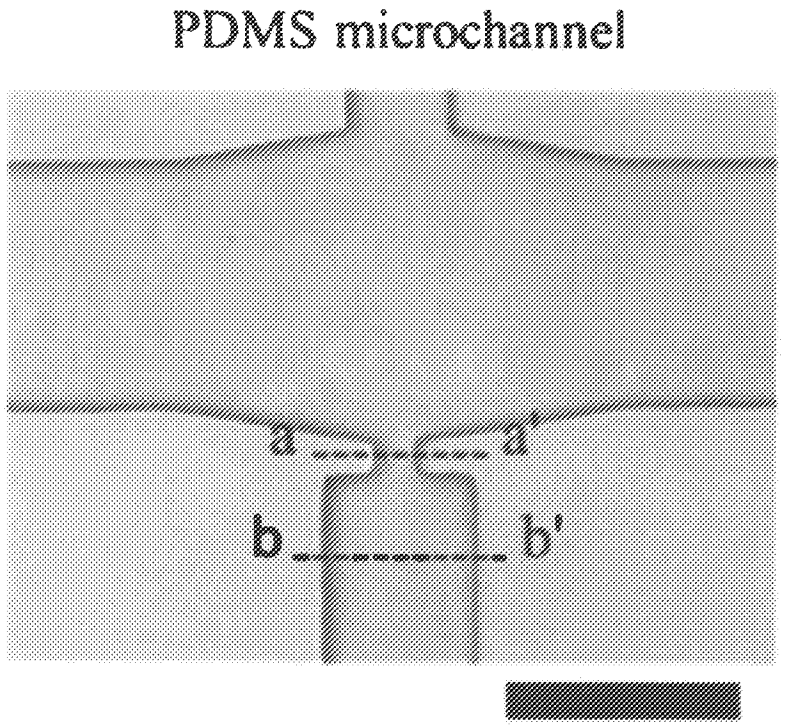
Figure 18E:
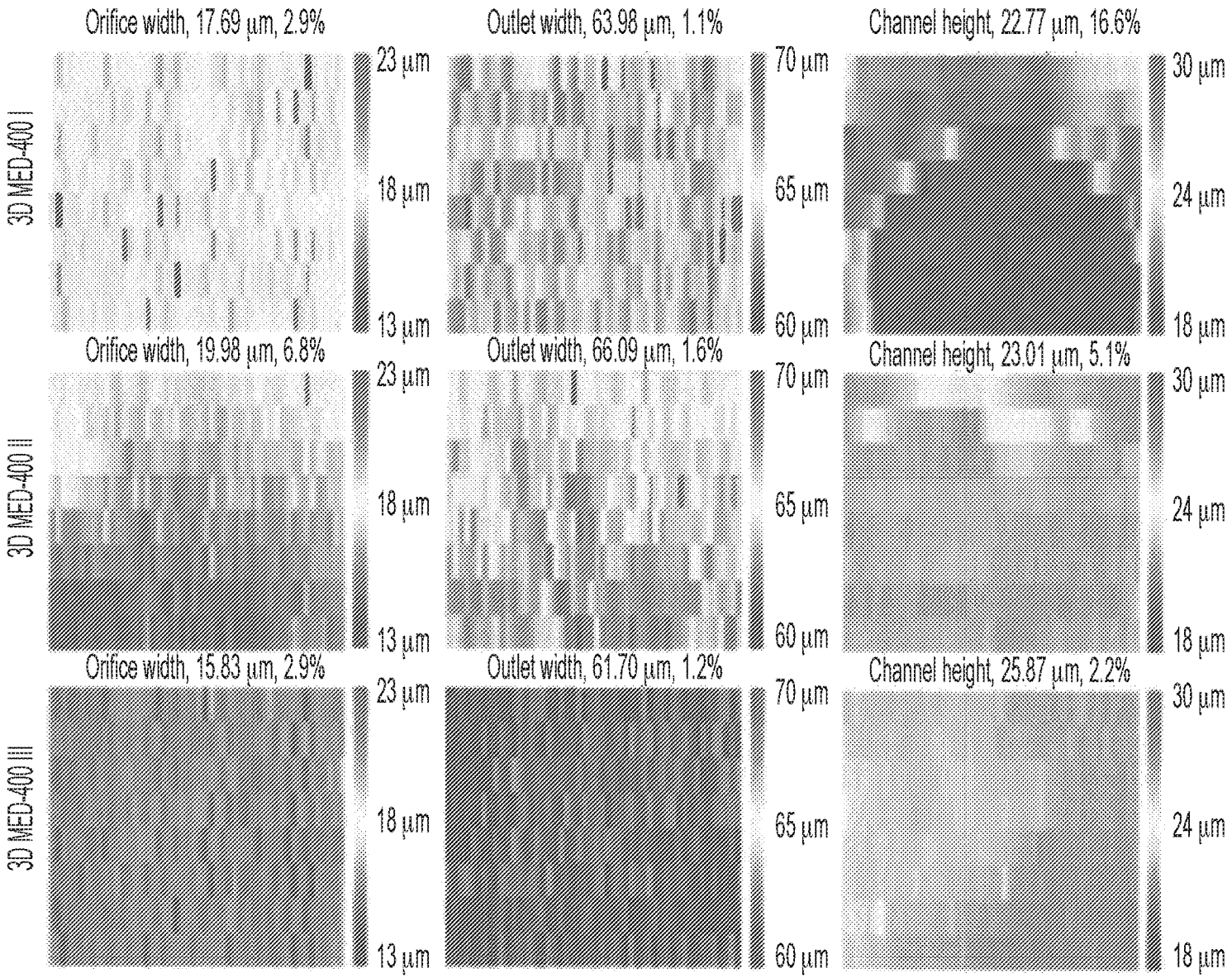
FIG. 18E illustrates heat maps for orifice/outlet width and height of FFG array in three embodiments, 3D MED-400 I, II, and III, of the 400 FFG integrated 3D MED design of FIG. 18A.

First, the fabrication tolerance of photo/soft-lithography was characterized using three different 3D MED-400 I, II, and III, as shown in FIGS. 18A-18E. In a photolithography process, a photomask resolution determines the dimension variation and edge roughness of the microchannels. The orifice width of the 400-FFGs array was measured using a photomask and represented by a heat map that shows hole variation (14.72 μm and 2.6% CV) for individual channel dimensions (FIGS. 18A-18B). To characterize the variation of microchannel resistance, the widths of orifices and outlet channels were measured by line profiling image analysis (FIGS. 18C-18D). The large variation of height (3D MED-400 I) or width (3D MED-400 II) on the 400 FFGs were compared to uniform microchannels fabricated by optimal condition (3D MED-400 III), as shown in FIG. 18E.

Using these devices, the mass production of G/W microbubbles was tested under 0.02 $Ca_{avg}$ and 0.0113 $u_d/u_c$, which are reasonable conditions to generate monodisperse microbubbles. To find correlations between hydrodynamic resistance and microbubble diameter, heat maps were plotted to illustrate the deviation and variation of generated microbubbles sizes as individual microchannel resistances for orifice and outlet channel of FFGs (FIG. 12C).

In the 3D MED-400 I, two distinct variation pattern were found on the heat maps for both orifice (17.9% CV) and outlet (42.4% CV) resistances, as shown in FIG. 12C. As expected, the 40.4 μm average diameter microbubbles was achieved with wide size distribution (13.6% CV) under high deviation of channel resistance. Also, two main variation patterns were found on the heat map for microbubble diameter variation, which is slightly correlated with channel resistance variation pattern for orifice and outlet channels. Commonly, smaller microbubbles are generated in higher channel resistance value. As shown in FIG. 12C, the 3D MED-400 II shows orifice resistance gradient starting from left edge FFGs and distinct variation of outlet resistance on top two row FFGs. The deviation of outlet channel resistance is significantly decreased to 12.5% CV compared to 42.4% CV at the 3D MED-400 I. As a results of microbubble size variation, 5.8% CV was achieved at 39.0 μm average microbubble diameter due to minimized variation of channel resistance. The variation of microbubble diameter on the top two row is correlated with outlet resistance variation and other row size variation is due to orifice resistance variation.

Figure 19A:
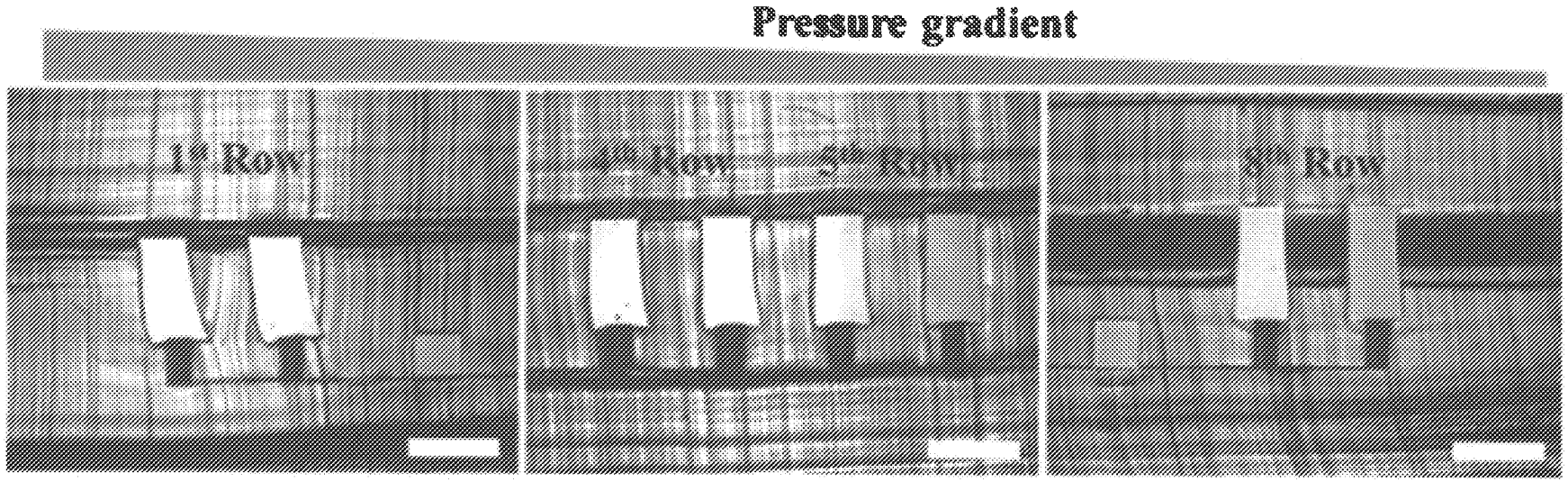
FIG. 19A is an image of distribution channels under various pressures applied during double-sided imprinting in accordance with aspects of the present invention.
Figures 19B, 19C:
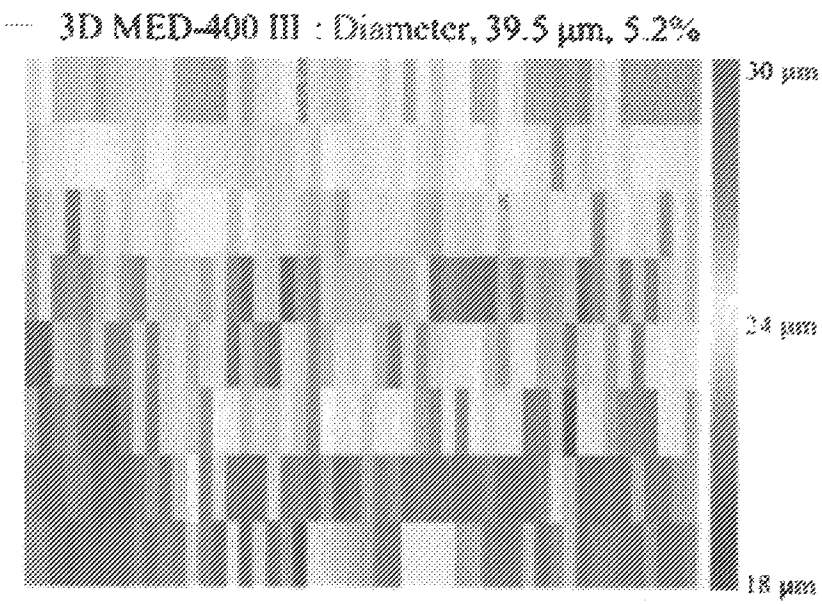
FIG. 19B is a heat map showing microbubble diameter variation at 39.5 μm average diameter for the 3D MED-400 III embodiment of FIG. 18E.
FIG. 19C is a table showing the change of average microbubble diameter at individual rows of distribution channel with gradually increased channel resistance for the 3D MED-400 III embodiment of FIG. 18E.

Finally, the 3D MED-400 III was tested with relatively uniform microchannels compared to 3D MED-400 I and II. Although deviations of microchannel dimension are below 3% CV, orifice (9.7% CV) and outlet resistance (6.7% CV) are still not uniform, as shown in FIG. 12C; thus, it may be difficult to obtain uniform channel resistance in resolution of below 30 μm microchannel in a photo/soft-lithography. A comparison of the variation pattern between the microchannel dimension and resistance shows that the orifice resistance variation randomly occurred as width variation of photomask/channel under uniform heights and the outlet resistance variation is similar with height variation pattern (FIG. 12C and FIG. 18E). In fact, the channel resistance variation also existed in single-FFG due to non-uniform width and height, such that deviation of channel resistance for entire 400-FFGs might be increased more than previously consideration for only orifice and outlet channel resistances. Despite the large channel resistance variation, a CV of 4.2% was achieved at 39.7 μm average microbubble diameter, which indicated that interaction between 400-FFGs can be less sensitive to channel resistance variation due to the two-phase flow resistance. In addition to FFGs variation, distribution channel variation was also found to affect the microbubble size distribution (FIGS. 19A-19C). Although the patterns of soft master mold is almost the same (<1% CV), the distribution channel structures is changed as pressure uniformity during device fabrication by using double-sided imprinting with higher pressure to induce a lower aspect ratio channel (FIG. 19A). A high pressure was applied to a first row of distribution channel, which exhibited a lower aspect ratio structures than other channels. The distribution channel dimension and its resistance variation and test the microbubble generation was characteristic and illustrated in FIGS. 19B and 19C. Due to non-uniform resistance of the distribution channel (18.1% CV), microbubble size distribution was increased to a CV of 5.2%. And, average microbubble size at a single row was decreased as the channel resistance increased from the $1^{st}$ row to the $8^{th}$ row. Thus, preferably both microbubble generation and distribution channels deviations are below 10% to generate monodisperse microbubbles (<5%).

Figure 13A:
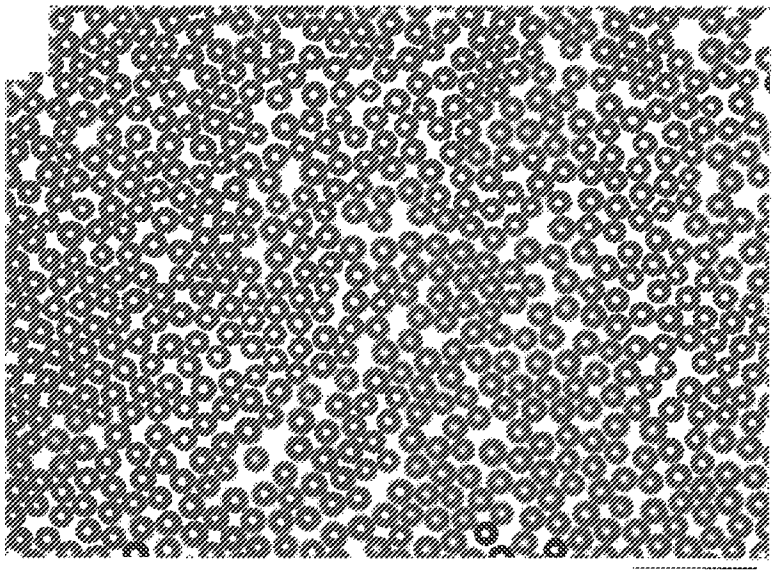
FIG. 13A is an optical image of gas microbubbles produced using 3D MED-400 III embodiment of FIG. 12C.
Figure 13B:
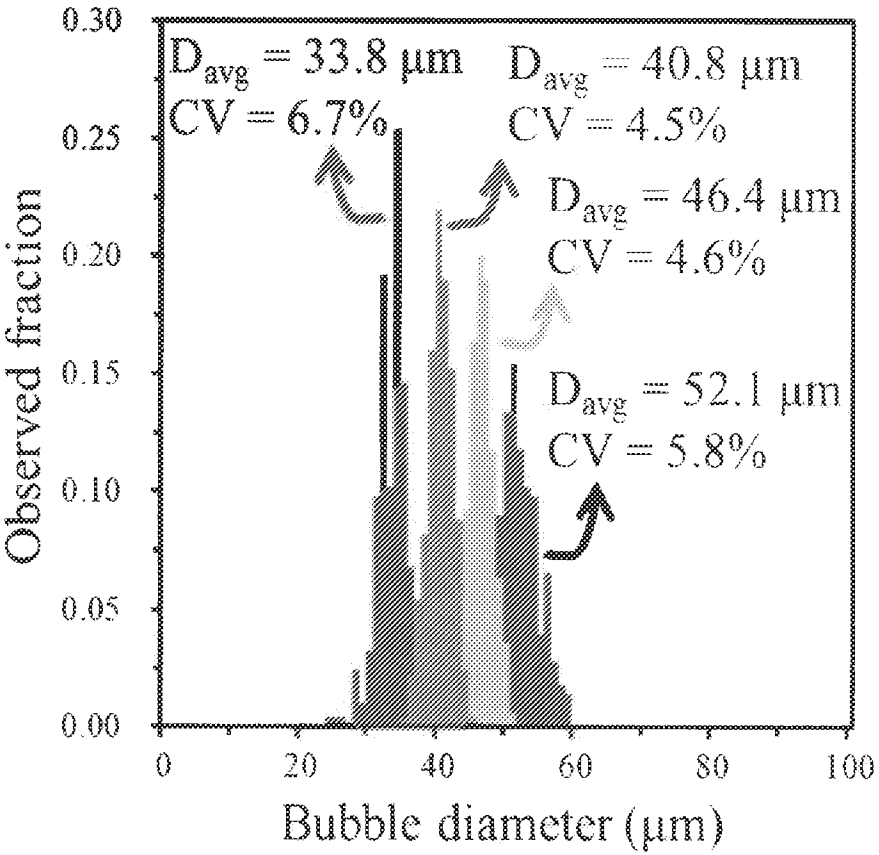
FIG. 13B is a graph illustrating the size distribution for the gas microbubbles of FIG. 13A as a function of gas pressure at fixed continuous phase.

Using the 3D MED-400 III that is shown in FIG. 12C, varying microbubble size was controlled by changing gas pressure (from 20 psi to 26 psi) at a fixed pressure for the continuous phase (40 psi), as shown in FIGS. 13A and 13B. A 39.7 μm average microbubble size was measured at outlet channels by considering a channel height for a replica PDMS mold (FIG. 12C) increased to a 46.4 μm size measured in collected product from an outlet tubing (FIG. 13A). The soft PDMS can be randomly expanded by high pressure applied to increase the production ratio, resulting in a difference of microbubble size between microchannel and collected product. As a result, the size distribution was changed as average microbubble size, consisting with the change of CV in 3D MED-8, as shown in FIG. 13B. The monodisperse gas microbubbles (<5% CV) are generated in a range of approximately 40.8-46.2 μm size at a production rate as high as 1 L/hour, for a given 1.5 L/hour flow rate of continuous phase. These results demonstrated that flow rate variation due to non-uniform channel resistance can be adjusted by acting the two-phase flow resistance on large-scale integration, resulting to mass production of monodisperse microbubbles.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method for manufacturing a microfluidic device comprising a plurality of flow-focusing generators, the method comprising the steps of:

forming a cavity between a first plate and a second plate, the cavity defining at least one fluid inlet, at least one fluid outlet, the plurality of flow focusing generators, a first plurality of channels, and a second plurality of channels;

supplying a resin to the cavity, applying pressure to one or both of the first plate or the second plate; and curing the resin so as to give rise to a three-dimensional monolithic substrate that defines therein at least one fluid inlet, at least one fluid outlet, the plurality of flow focusing generators, the first plurality of channels, and the second plurality of channels.

2. The method of claim 1, wherein the plurality of flow focusing generators are in fluid communication with the first plurality of channels and the second plurality of channels, and wherein the first plurality of channels passes under or over the second plurality of channels.

3. The method of claim 1, wherein the second plate is a hard master formed of a plurality of layers of resin, and the hard master further comprises at least a first layer forming a plurality of flow focusing generators and at least a second layer forming a via for each of the plurality of flow focusing generators.

4. A microdroplet generator comprising: a three-dimensional monolithic substrate including an inlet for receiving a continuous phase fluid, an inlet for receiving a dispersed phase fluid, a plurality of channels, the plurality of channels in fluid communication with both the inlet of the continuous phase fluid and the inlet of the dispersed phase fluid, a plurality of flow focusing generators configured to produce microdroplets, each of the flow focusing generators in fluid communication with the plurality of channels, and one or more outlets for delivery of the microdroplets, wherein a number of the plurality of flow-focusing generators is more than two greater than a number of the one or more outlets for delivery of the microdroplets.

5. The microdroplet generator of claim 4, wherein the plurality of channels further comprise supply channels and delivery channels, the supply channels having a hydrodynamic resistance that is less than a hydrodynamic resistance of the delivery channels.

6. The microdroplet generator of claim 5, wherein the hydrodynamic resistance of the supply channels is less than 1% of the hydrodynamic resistance of the delivery channels.

7. The microdroplet generator of claim 5, wherein each supply channel is in fluid communication with a plurality of delivery channel and each delivery channel is in fluid communication with two or more flow focusing generators.

8. The microdroplet generator of claim 6, wherein the supply channels and the delivery channels are configured to form a ladder geometry.

9. The microdroplet generator of claim 7, wherein the plurality of delivery channels of either the first fluid or the second fluid passes under or over the supply channel of the second fluid.

10. The microdroplet generator of claim 4, further configured to produce monodisperse microbubbles.

11. The microdroplet generator of claim 4, wherein the microchannel dimensions have a coefficient variation of 3% or less.

12. The microdroplet generator of claim 4, wherein the outlets have a coefficient variation of 6.5% or less.

13. The microdroplet generator of claim 4, wherein each of the plurality of flow-focusing generators have an orifice, each orifice having a coefficient variation of 12.4% or less.

* * * * *